US009963959B2

(12) United States Patent
Parsche

(10) Patent No.: US 9,963,959 B2
(45) Date of Patent: May 8, 2018

(54) HYDROCARBON RESOURCE HEATING APPARATUS INCLUDING UPPER AND LOWER WELLBORE RF RADIATORS AND RELATED METHODS

(71) Applicant: HARRIS CORPORATION, Melbourne, FL (US)

(72) Inventor: Francis Eugene Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 288 days.

(21) Appl. No.: 14/848,377

(22) Filed: Sep. 9, 2015

(65) Prior Publication Data

US 2015/0377001 A1 Dec. 31, 2015

Related U.S. Application Data

(62) Division of application No. 13/363,914, filed on Feb. 1, 2012, now Pat. No. 9,157,303.

(51) Int. Cl.

| | |
|---|---|
| ***E21B 43/24*** | (2006.01) |
| ***E21B 36/04*** | (2006.01) |
| ***H05B 6/72*** | (2006.01) |

(52) U.S. Cl.

CPC ..... *E21B 43/2401* (2013.01); *E21B 43/2408* (2013.01); *H05B 6/72* (2013.01); *E21B 43/2406* (2013.01); *H05B 2214/03* (2013.01)

(58) Field of Classification Search

CPC .. E21B 43/24; E21B 43/2401; E21B 43/2406; E21B 43/2408; E21B 36/04; E21B 36/00; H05B 2214/03; H05E 36/00; H05E 36/02; H05E 36/46; H05E 36/48; H05E 36/50; H05E 36/52

USPC ..... 166/248, 272.1, 272.3; 324/332, 333, 324/344, 347, 354, 355

See application file for complete search history.

(56) References Cited

U.S. PATENT DOCUMENTS

| | | | | |
|---|---|---|---|---|
| 560,861 A | | 5/1896 | Pickernell et al. | |
| 2,757,738 A | | 8/1956 | Ritchey | |
| 4,470,459 A | * | 9/1984 | Copland | E21B 36/04 166/248 |
| 4,697,191 A | * | 9/1987 | Cross | H01Q 1/04 343/719 |

(Continued)

FOREIGN PATENT DOCUMENTS

WO 2010120408 10/2010

*Primary Examiner* — George S Gray

(74) *Attorney, Agent, or Firm* — Allen, Dyer, Doppelt + Gilchrist, P.A.

(57) ABSTRACT

A device for heating a hydrocarbon resource in a subterranean formation having at least one pair of laterally extending upper and lower wellbores therein may include a radio frequency (RF) source. The device may also include an upper wellbore RF radiator to be positioned in the laterally extending upper wellbore and including a plurality of first terminals. The device may further include a lower wellbore RF radiator to be positioned in the laterally extending lower wellbore and comprising a plurality of second terminals. The device may also include an interconnection arrangement configured to couple the RF source and the first and second terminals so that at least one of the upper and lower wellbore RF radiators heat the hydrocarbon resource in the subterranean formation.

15 Claims, 15 Drawing Sheets

(56) References Cited

U.S. PATENT DOCUMENTS

| | | | | |
|---|---|---|---|---|
| 5,046,559 | A | 9/1991 | Glandt | |
| 5,065,819 | A * | 11/1991 | Kasevich | E21B 36/04 166/248 |
| 5,293,936 | A * | 3/1994 | Bridges | E21B 36/04 166/248 |
| 7,441,597 | B2 | 10/2008 | Kasevich | |
| 7,556,099 | B2 | 7/2009 | Arthur et al. | |
| 7,562,708 | B2 | 7/2009 | Cogliandro et al. | |
| 7,688,428 | B2 | 3/2010 | Pearlman | |
| 7,719,267 | B2 | 5/2010 | Pusiol | |
| 7,728,291 | B2 | 6/2010 | Bello | |
| 7,741,841 | B2 | 6/2010 | Edwards et al. | |
| 7,753,119 | B2 | 7/2010 | Chen et al. | |
| 7,781,737 | B2 | 8/2010 | Zhdaneev | |
| 7,798,221 | B2 | 9/2010 | Vinegar et al. | |
| 7,875,455 | B1 | 1/2011 | Li et al. | |
| 2010/0078163 | A1 | 4/2010 | Banerjee et al. | |
| 2010/0294488 | A1 | 11/2010 | Wheeler et al. | |
| 2010/0294489 | A1 | 11/2010 | Dreher, Jr. et al. | |

* cited by examiner

HYDROCARBON RESOURCE HEATING APPARATUS INCLUDING UPPER AND LOWER WELLBORE RF RADIATORS AND RELATED METHODS

FIELD OF THE INVENTION

The present invention relates to the field of hydrocarbon resource recovery, and, more particularly, to hydrocarbon resource recovery using RF heating.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in tar sands where their viscous nature does not permit conventional oil well production. The American Petroleum Institute (API) gravity and/or permeability of most North American tar sand formations may be unsuitable to permit economic extraction by conventional techniques. Estimates are that trillions of barrels of oil reserves may be found in such tar sand formations.

In some instances these tar sand deposits are currently extracted via open-pit mining. Another approach for in situ extraction for deeper deposits is known as Steam-Assisted Gravity Drainage (SAGD). The heavy oil is immobile at reservoir temperatures and therefore the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the payzone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen which allows it to flow down into the lower producer well where it is collected and recovered. The steam and gases rise due to their lower density so that steam is not produced at the lower producer well and steam trap control is used to the same affect. Gases, such as methane, carbon dioxide, and hydrogen sulfide, for example, may tend to rise in the steam chamber and fill the void space left by the oil defining an insulating layer above the steam. Oil and water flow is by gravity driven drainage, into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Steam injection EOR methods may be unreliable. For example, the well may not start, as convective flow is typically necessary to convey the steam underground, and this flow may not occur due to shale layers, thief zones, wormholes or other reasons as underground information may be incomplete. Conducted heating may be desired to initiate flow for steam convection, yet the thermal conductivity of oil sands may be unsatisfactorily poor: about 1.5 watts/meter degree Kelvin for oil sand versus 401 watts/meter degree Kelvin for copper. Thus, the conducted heating in oil sand to initiate convective flow may be relatively slow, unreliable, and costly.

Caprock, which generally includes the steam may not be present over the hydrocarbon payzone. This may be especially problematic to oil sand extraction in the Saskatchewan Province, Canada. In permafrost zones, steam EOR may be impractical due to melting at the surface. Steam plants may be difficult to transport, so production delays may occur in steam plant deployment. Additionally, there may be insufficient surface water to make the steam. Often the water rights may be owed by legacy producers inhibiting the entry of new producers.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, although due to the 2008 economic downturn work on new projects has been deferred, while Venezuelan production has been declining in recent years. Oil is not yet produced from oil sands on a significant level in other countries. Oil sands may be porous microstructures with sand grains in bitumen coated water pores. A nominal oil sand from the Athabasca region of Canada may have 10-13% bitumen and 3.5 to 8% water by weight.

U.S. Published Patent Application No. 2010/0078163 to Banerjee et al. discloses a hydrocarbon recovery process whereby three wells are provided: an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Application No. 2010/0294489 to Dreher, Jr. et al. discloses using microwaves to provide heating. An activator is injected below the surface and is heated by the microwaves, and the activator then heats the heavy oil in the production well. U.S. Published Application No. 2010/0294488 to Wheeler et al. discloses a similar approach. The penetration of heating energies at microwave frequencies may not be large.

U.S. Pat. No. 7,441,597 to Kasevich discloses using a radio frequency generator to apply RF energy to a horizontal portion of an RF well positioned above a horizontal portion of a oil/gas producing well. The viscosity of the oil is reduced as a result of the RF energy, which causes the oil to drain due to gravity. The oil is recovered through the oil/gas producing well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD which impacts the environment. Limited water resources may also limit oil recovery. SAGD is also not an available process in permafrost regions, for example.

SUMMARY OF THE INVENTION

In view of the foregoing background, it is therefore an object of the present invention to more efficiently recover hydrocarbon resources from a subterranean formation and while potentially using less energy and providing faster recovery of the hydrocarbons.

This and other objects, features, and advantages in accordance with the present invention are provided by an apparatus for heating a hydrocarbon resource in a subterranean formation having at least one pair of laterally extending upper and lower wellbores therein. The apparatus includes a radio frequency (RF) source and an upper wellbore RF radiator configured to be positioned in the laterally extending upper wellbore and including a plurality of first terminals. The apparatus also includes a lower wellbore RF radiator configured to be positioned in the laterally extending lower wellbore and including a plurality of second terminals. The apparatus further includes an interconnection arrangement configured to couple the RF source and the first and second terminals so that at least one of the upper and lower wellbore RF radiators heat the hydrocarbon resource in the subterranean formation. Accordingly, the hydrocarbon resource is heated in the subterranean formation, which advantageously may increase hydrocarbon recovery efficiency, and thus reduce overall production times.

The upper wellbore RF radiator may include a proximal tubular conductor, a distal tubular conductor, and a feed area therebetween. The upper wellbore RF radiator may further include first and second feed conductors extending through the proximal tubular conductor, for example. The first feed conductor may be coupled to the proximal tubular conductor at the feed area. The second feed conductor may be coupled to the distal tubular conductor at the feed area, for example.

The lower wellbore RF radiator may further include a proximal tubular conductor, a distal tubular conductor, and a feed area therebetween. The lower wellbore RF radiator may further include first and second feed conductors extending through the proximal tubular conductor. The first feed conductor may be coupled to the proximal tubular conductor at the feed area, for example. The second feed conductor may be coupled to the distal tubular conductor at the feed area.

A method aspect is directed to a method for heating a hydrocarbon resource in a subterranean formation having at least one pair of laterally extending upper and lower wellbores therein, an upper wellbore RF radiator positioned in the laterally extending upper wellbore and comprising a plurality of first terminals, and a lower wellbore RF radiator positioned in the laterally extending lower wellbore and comprising a plurality of second terminals. The method includes selectively coupling an RF source and the first and second terminals so that at least one of the upper and lower wellbore RF radiators heat the hydrocarbon resource in the subterranean formation.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation is used to indicate similar elements in alternative embodiments.

Figure 1:
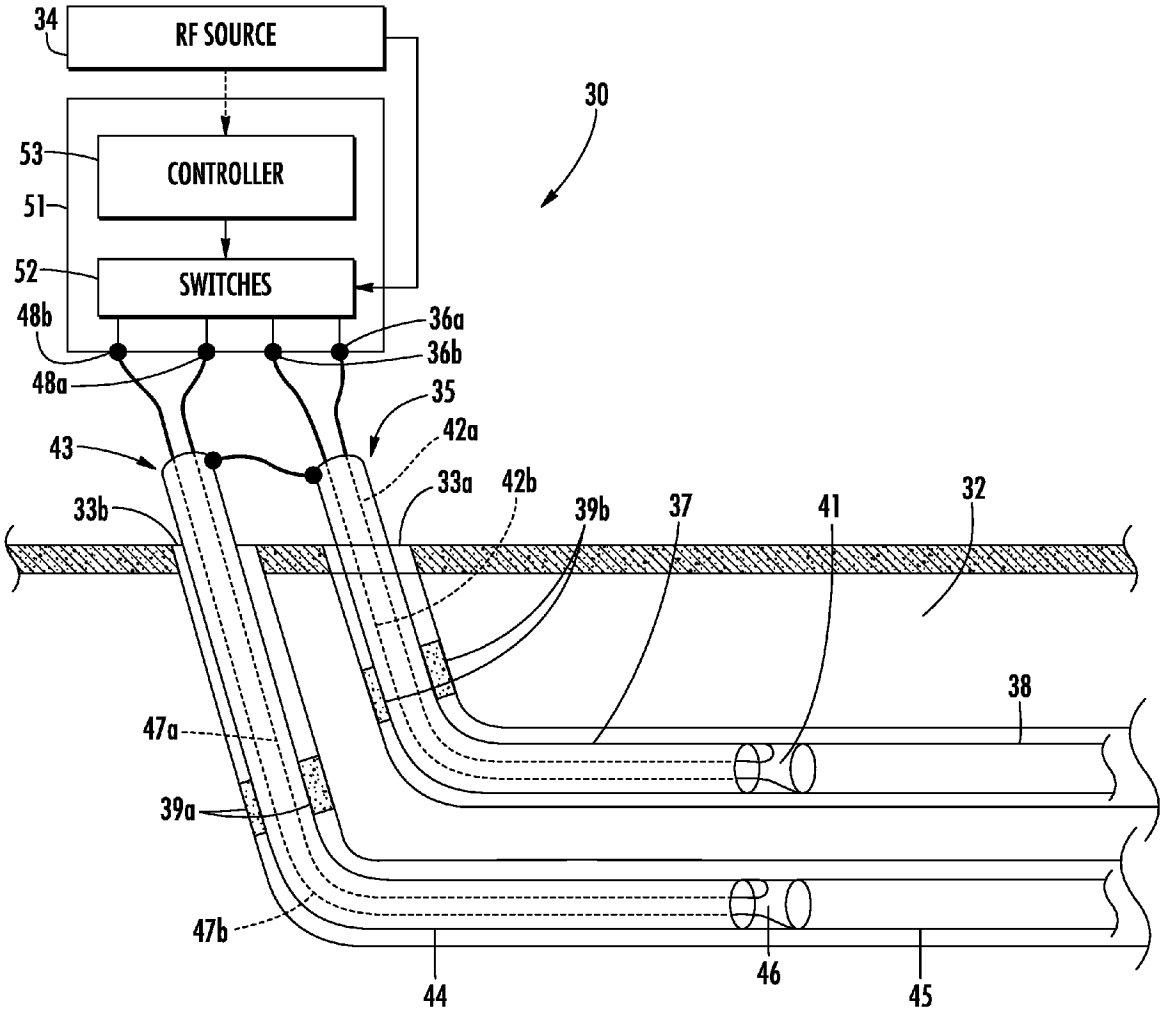
FIG. 1 is a schematic diagram of an apparatus for heating a hydrocarbon resource in accordance with the present invention.
Figure 2:
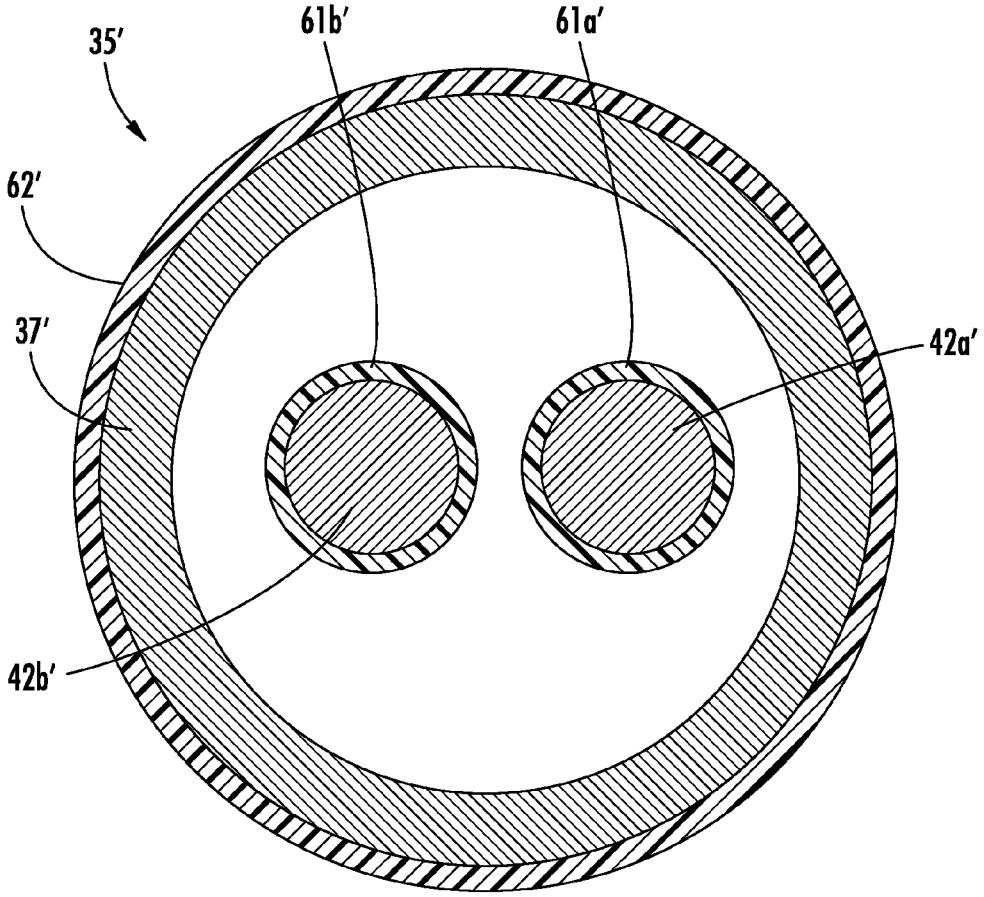
FIG. 2 is a cross-section of a portion of an RF radiator according to another embodiment.

Referring initially to FIGS. 1 and 2, an apparatus 30 for heating a hydrocarbon resource in a subterranean formation 32 having a pair of laterally extending upper and lower wellbores therein 33*a*, 33*b* illustratively includes a radio frequency (RF) source 34. The RF source 34 is positioned above the subterranean formation 32. The RF power source 34 may be a power generator, such as a high speed alternator. The RF source 34 may be an electronic RF source, particularly at higher frequencies, such as an oscillator, an amplifier, or a combination oscillator-amplifier. Thermionic devices such as a vacuum tube may be used in the RF source 34 such as the type 8974/X-2159 tetrode by CPI Eimac of Palo Alto, Calif. Alternatively, an array of transistors may be used to form the RF source 34, for example.

The laterally extending upper and lower wellbores 33*a*, 33*b* may be formed by horizontal directional drilling (HDD), for example. The laterally extending upper and lower wellbores 33*a*, 33*b* may each extend about 1,000 meters in length within the subterranean formation 32 and be about 50 to 400 meters underground. While this particular arrangement may be particularly useful in SAGD, other processes may be used. Of course, the laterally extending upper and lower wellbores 33*a*, 33*b* may each extend different lengths and may extend different depths, which may be based upon the geography of the subterranean formation 32, the payzone depth, and the type of hydrocarbon resource, for example, as will be appreciated by those skilled in the art.

The apparatus 30 may include provisions for hydrocarbon extraction such as perforated tubing and pumps (not shown), so one or more of the laterally extending upper and lower wellbores 33*a*, 33*b* may be extract hydrocarbons. An extraction wellbore (not shown) may be included in addition to the laterally extending upper and lower wellbores 33*a*, 33*b* to provide gravity drainage of hydrocarbons.

The apparatus 30 includes an upper wellbore RF radiator 35 positioned in the laterally extending upper wellbore 33*a*. The upper wellbore RF radiator 35 includes a pair of first terminals 36*a*, 36*b*. The upper wellbore RF radiator 35 includes a proximal tubular conductor 37, a distal tubular conductor 38, and a feed area 41 therebetween. The feed area 41 may be an insulated gap between the proximal tubular conductor 37 and the distal tubular conductor 38. The upper wellbore RF radiator 35 also includes first and second feed conductors 42*a*, 42*b* extending through the proximal tubular conductor 37.

In the payzone the proximal tubular conductor 37 provides radio frequency electromagnetic heating. In the overburden region the proximal tubular conductor 37 provides a shielded transmission line to reduce unwanted overburden heating, which would be uneconomic. The wall of the proximal tubular conductor 37 is preferentially many radio frequency skin depths thick to so that its external surfaces function as a conductor of radio frequency electrical currents for heating while the internal surfaces of the proximal tubular conductor 37 function as a transmission line shield or "Faraday Cage". The radio frequency electric currents typically do not appreciably heat the proximal tubular conductor 37, as it may be a good conductor.

Rather, electric currents are conveyed by the proximal tubular conductor 37 through the subterranean formation 32 to transduce electric and magnetic fields and waves into the subterranean formation. The electric and magnetic fields and waves dissipate as heat in the formation after penetrating the formation. The proximal tubular conductor 37 can also feed electric currents into conductive subterranean formation in electrode like fashion to provide joule effect heating of the ore. As background, Canadian Athabasca oil sands may have an electrical conductivity of about 0.002 to 0.2 mhos per meter due to connate in situ water and the dissolved salts and carbon dioxide in that water. The electromagnetic energies may first penetrate and heat the connate pore water, and then the connate pore water conductively heats the hydrocarbons.

Radio frequency electrical currents are fed onto the outside of the proximal tubular conductor 37 at the feed area 41. In some embodiments, electrical chokes 39*a*, 39*b* may be included to reduce unwanted heating of the overburden, which may not contain hydrocarbon resources. The electrical chokes 39*a*, 39*b* may be sleeves of ferrite or powdered iron surrounding the upper wellbore radiator 35 and the lower wellbore radiator 43. The electrical chokes 39*a*, 39*b* may provide an inductive reactance to electrical currents flowing on the outer surface of the upper wellbore radiator 35 and the lower wellbore radiator 43 sufficient to reduce their travel into the overburden regions. Other types of electrical chokes 39*a*, 39*b* include ¼ wavelength metallic sleeves connected to the proximal tubular conductor 37 at the proximal end, or toroidal windings.

The first feed conductor 42*a* is coupled to the proximal tubular conductor 37 at the feed area 41. The second feed conductor 42*b* is coupled to the distal tubular conductor 38 at the feed area 41. The first and second feed conductors 42*a*, 42*b* may be in the form of a twinaxial cable, for example. In some embodiments the first feed conductor 42*a* may be omitted, in which case the inside surfaces of the proximal tubular conductor 37 may convey the electrical current. In other words, twinaxial or coaxial cable may be used. As will be appreciated by those skilled in the art, the proximal and distal tubular conductors 37, 38 advantageously define a linear dipole antenna as electric currents diverge and converge from the feed area 41. For example, there may be as many as 8 different electromagnetic energies and fields created in the subterranean formation 32 by the proximal and distal tubular conductors 37, 38, which will be discussed in greater detail below.

The apparatus 30 includes a lower upper wellbore RF radiator 43 positioned in the laterally extending lower wellbore 33*b*. The lower wellbore RF radiator 43 includes a pair of second terminals 48*a*, 48*b*.

The lower wellbore RF radiator 43 includes a proximal tubular conductor 44, a distal tubular conductor 45, and a feed point 46 therebetween. The lower wellbore RF radiator 43 also includes first and second feed conductors 47*a*, 47*b* extending through the proximal tubular conductor 44. The first and second feed conductors 47*a*, 47*b* of the lower wellbore RF radiator 43 may also be surrounded by respective dielectric material layers similar to the first and second feed conductors 42*a*, 42*b* of the upper wellbore RF radiator 35. The first feed conductor 47*a* is coupled to the proximal tubular conductor 44 at the feed point 46. The second feed conductor 47*b* is coupled to the distal tubular conductor 45 at the feed point 46. The first and second feed conductors 47*a*, 47*b* may be in the form of a twinaxial cable, for example. In other words, the lower wellbore RF radiator 43 is configured similar to the upper wellbore RF radiator 35.

Electrical insulation may optionally be provided around the upper and lower wellbore RF radiators 35, 43. The electrical insulation may be a dielectric pipe, for example, enclosing the upper and lower wellbore RF radiators 35, 43 or a coating.

As will be appreciated by those skilled in the art, the proximal and distal tubular conductors 44, 45 of the lower wellbore RF radiator 43 also advantageously define a dipole antenna. Additionally, the upper wellbore proximal tubular conductor 37 is coupled to the lower wellbore proximal conductor 44 above the subterranean formation 32. The proximal and distal tubular conductors 44, 45 similar to the upper wellbore RF radiator 35, may be surrounded by respective dielectric material layers.

The apparatus 30 further includes an interconnection arrangement 51 selectively coupling the RF source 34 and the first and second terminals 36, 48 so that either or both of the upper and lower wellbore RF radiators 35, 43 heat the hydrocarbon resource in the subterranean formation 32. More particularly, the interconnection arrangement 51 includes switches 52 and a controller 53 cooperating with the switches to selectively couple either or both of the first and second terminals 36, 48 to the RF source 34. In other words, the controller 53 and the switches 52 cooperate to selectively couple ones of the upper and lower wellbore feed conductors 42, 47 to the RF source 34 so that either, both or none, of either the upper and lower wellbore proximal and distal tubular conductors 37, 44, 38, 45 heat the hydrocarbon resource. The interconnection arrangement 51 is positioned above the subterranean formation 32.

Referring now additionally to FIG. 2, in another embodiment, the first and second feed conductors 42*a*', 42*b*' may be insulated. In other words the first and second feed conductors 42*a*', 42*b*' may be surrounded by respective first and second dielectric material layers 61*a*', 61*b*'.

The proximal tubular conductor 37' may also be surrounded by a dielectric material layer 62'. The distal tubular conductor 38' may also be surrounded by a dielectric material layer. The dielectric material layer 62' may advantageously reduce the amount of electric supplied from the proximal tubular conductor 37' to the adjacent subterranean formation 32' so as to raise the electrical impedance of the RF heating apparatus 30, e.g. the dielectric material layer 62' reduces the 35', 43' wellbore RF radiators from being contact electrodes. When the dielectric material layer 62' is present RF heating is provided as a displacement current/capacitive coupling, magnetic field induction, or even dielectric heating by radiation of far field electromagnetic waves, for example.

Referring now additionally to FIGS. 3-8, various switch arrangements of the interconnection arrangement 51 and corresponding heating patterns 49 are illustrated. The switch arrangements allow movement of the location of the subterranean heating, for example, to concentrate heat between the wells for rapid startup of convective flows. Other combinations of switch throws can reduce heating between the laterally extending upper and lower wellbores 33*a*, 33*b* to maintain liquid levels between the laterally extending upper and lower wellbores to provide a steam trap between the laterally extending upper and lower wellbores. The various switch throws may also cause antiparallel (opposite direction) electrical currents on the laterally extending upper and lower wellbores 33*a*, 33*b* to allow extended broadside heating from the plane of the laterally extending upper and lower wellbores. The antiparallel current heating mode may enhance production of hydrocarbon resources at the heating front of a steam saturation zone (steam bubble) that can surround the RF heating apparatus 30, if desired.

Figure 3:
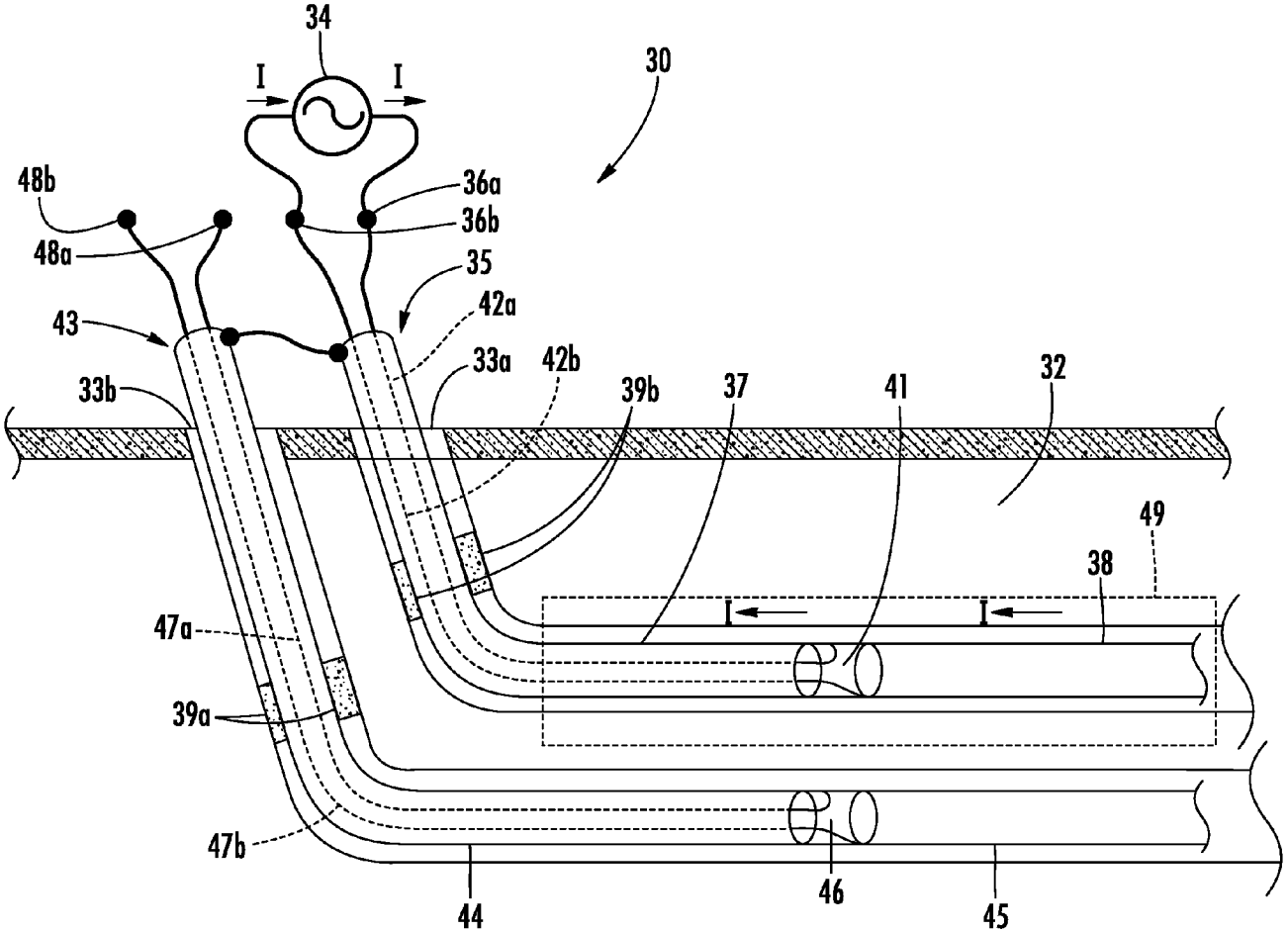
FIG. 3 is a schematic diagram of the apparatus of FIG. 1 coupled in an upper dipole mode arrangement.

With respect to FIG. 3, the RF source 31 is coupled to the first terminals 36*a*, 36*b*, and thus, the first and second feed conductors 42*a*, 42*b* of the upper wellbore. The upper wellbore proximal tubular conductor 37 is coupled to the lower wellbore proximal tubular conductor 44 above the subterranean formation 32.

The upper wellbore RF radiator 35, and in particular, both the proximal and distal tubular conductors 37, 38 heat the hydrocarbon resource both above and below the laterally extending upper wellbore 33*a*, as illustrated by heat pattern 49. Current I flows from the RF source 34 along the first feed conductor 42*a* and toward the RF source 34 along the proximal and distal tubular conductors 37, 38 as illustrated. The apparatus 30 may be considered to be operating in an upper dipole mode.

Figure 4:
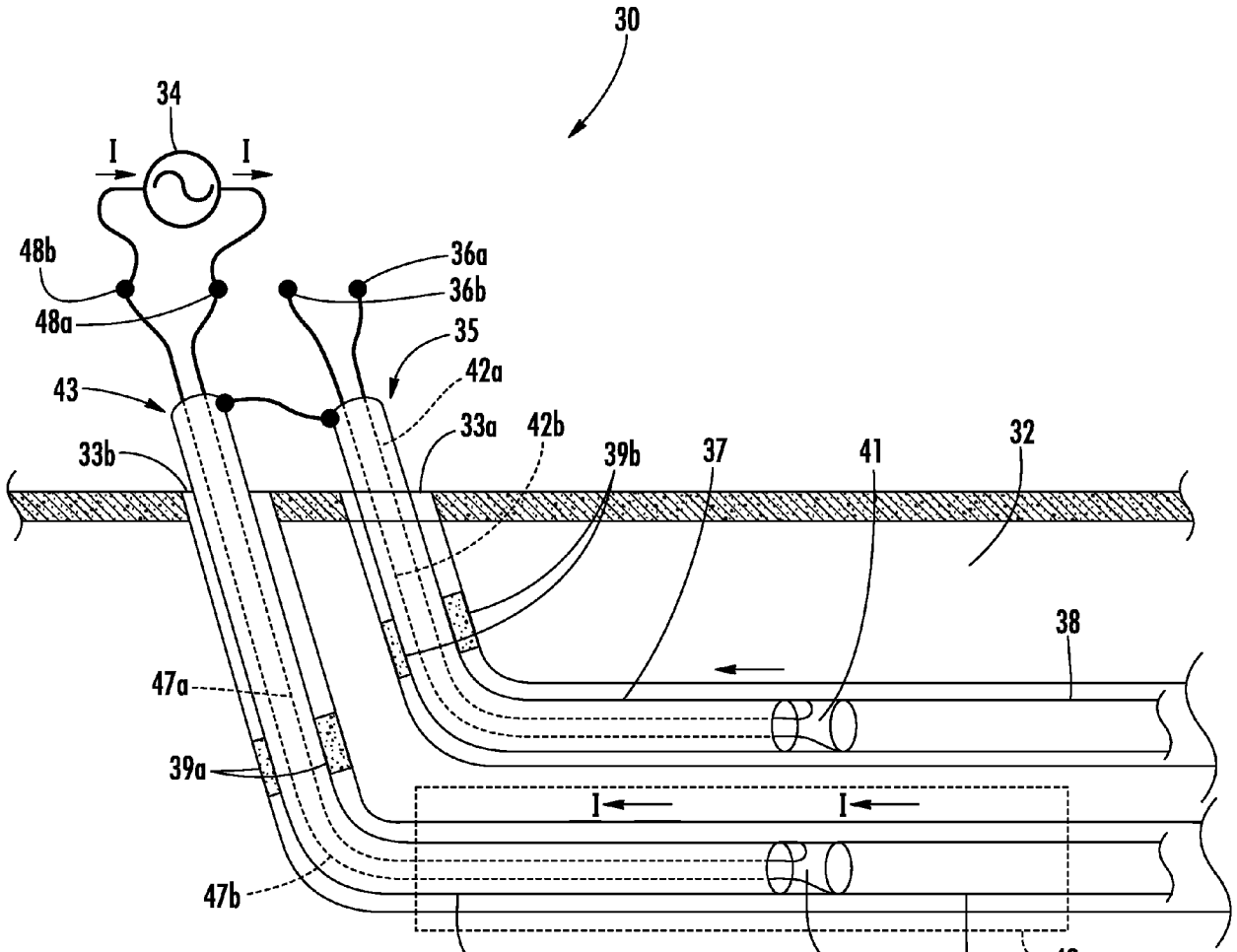
FIG. 4 is a schematic diagram of the apparatus of FIG. 1 coupled in a lower dipole mode arrangement.

With respect to FIG. 4, the RF source 31 is coupled to the second terminals 48*a*, 48*b*, and thus, the first and second feed conductors 47*a*, 47*b* of the lower wellbore 33*b*. The upper wellbore proximal tubular conductor 37 is coupled to the lower wellbore proximal conductor 44 above the subterranean formation 32.

The lower wellbore RF radiator 43, and in particular, both the proximal and distal tubular conductors 44, 45 heat the hydrocarbon resource both above and below the laterally extending lower wellbore 33*b*, as illustrated by heat pattern 49. Current I flows from the RF source 34 along the first feed conductor 47*a* and toward the RF source along the proximal and distal tubular conductors 44, 45 as illustrated. The apparatus 30 may be considered to be operating in a lower dipole mode.

Figure 5:
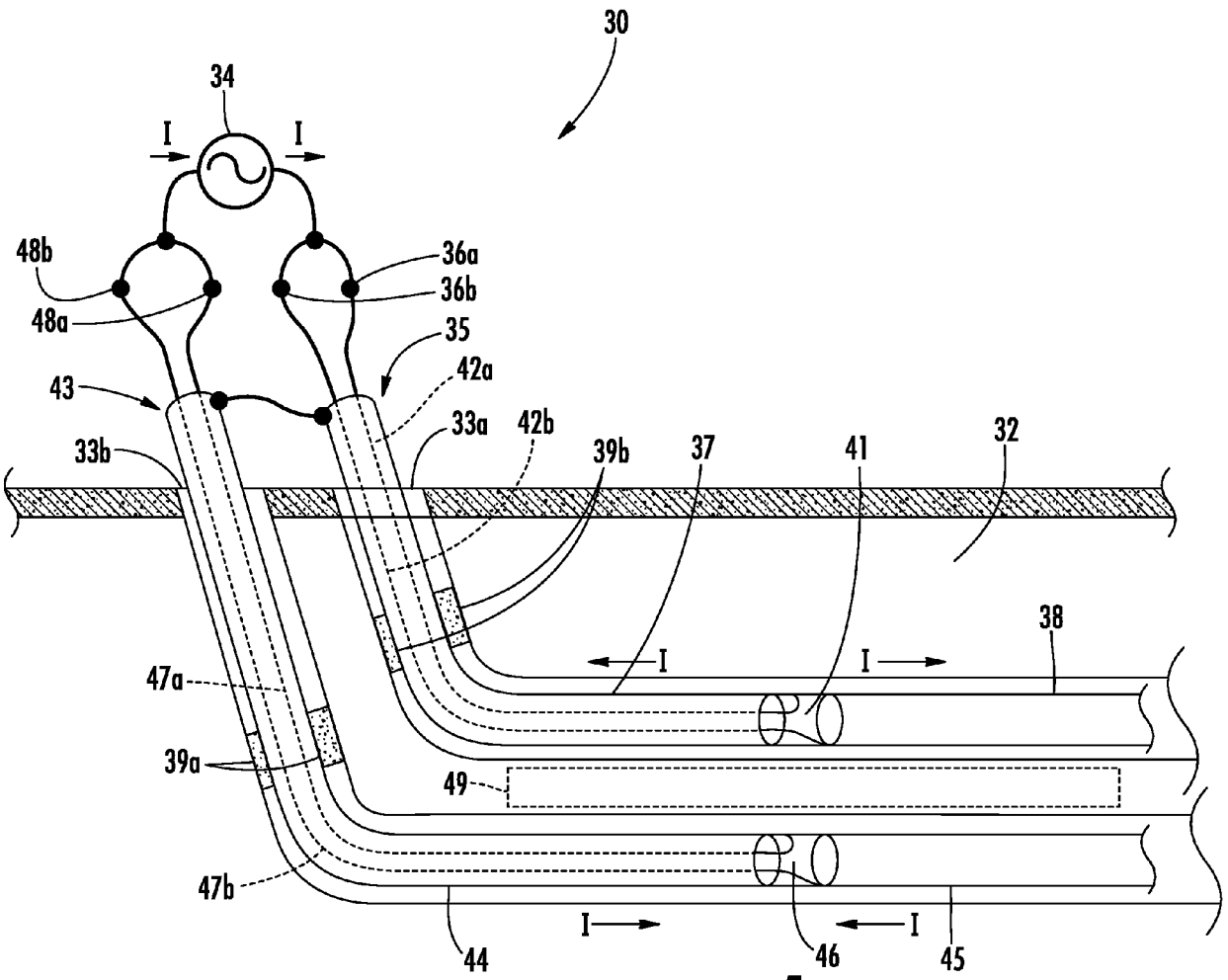
FIG. 5 is a schematic diagram of the apparatus of FIG. 1 coupled in a slot mode arrangement.

Referring now additionally to FIG. 5, an embodiment may provide enhanced heating between the laterally extending upper and lower wellbores 33*a*, 33*b*. This embodiment may be advantageous for starting up a SAGD well to initiate convective flows between the laterally extending upper and lower wellbores 33*a*, 33*b* by concentrating the heating therebetween. The RF source 31 is coupled to the first terminals 36*a*, 36*b* and second terminals 48*a*, 48*b*, and thus, the first and second feed conductors 47*a*, 47*b* of the upper and lower wellbores. The upper wellbore proximal tubular conductor 37 is coupled to the lower wellbore proximal tubular conductor 44 above the subterranean formation 32.

The upper wellbore RF radiator 35, and in particular, both the proximal and distal tubular conductors 37, 38 heat the hydrocarbon resource below the laterally extending upper wellbore 33*a*, as illustrated by heat pattern 49. The lower wellbore RF radiator 43, and in particular, both the proximal and distal tubular conductors 44, 45 heat the hydrocarbon resource above the laterally extending lower wellbore 33*b*, as illustrated by heat pattern 49. In other words, the hydrocarbon resource in the subterranean formation 32 between the upper and lower laterally extending wellbores 33*a*, 33*b* is heated.

Current I flows along the upper wellbore proximal and distal tubular conductors 37, 38 away from the upper wellbore feed point 41. Current I flows along the lower wellbore proximal and distal tubular conductors 44, 45 toward the lower wellbore feed point 46. The apparatus 30 may be considered to be operating in a slot dipole mode.

Figure 6:
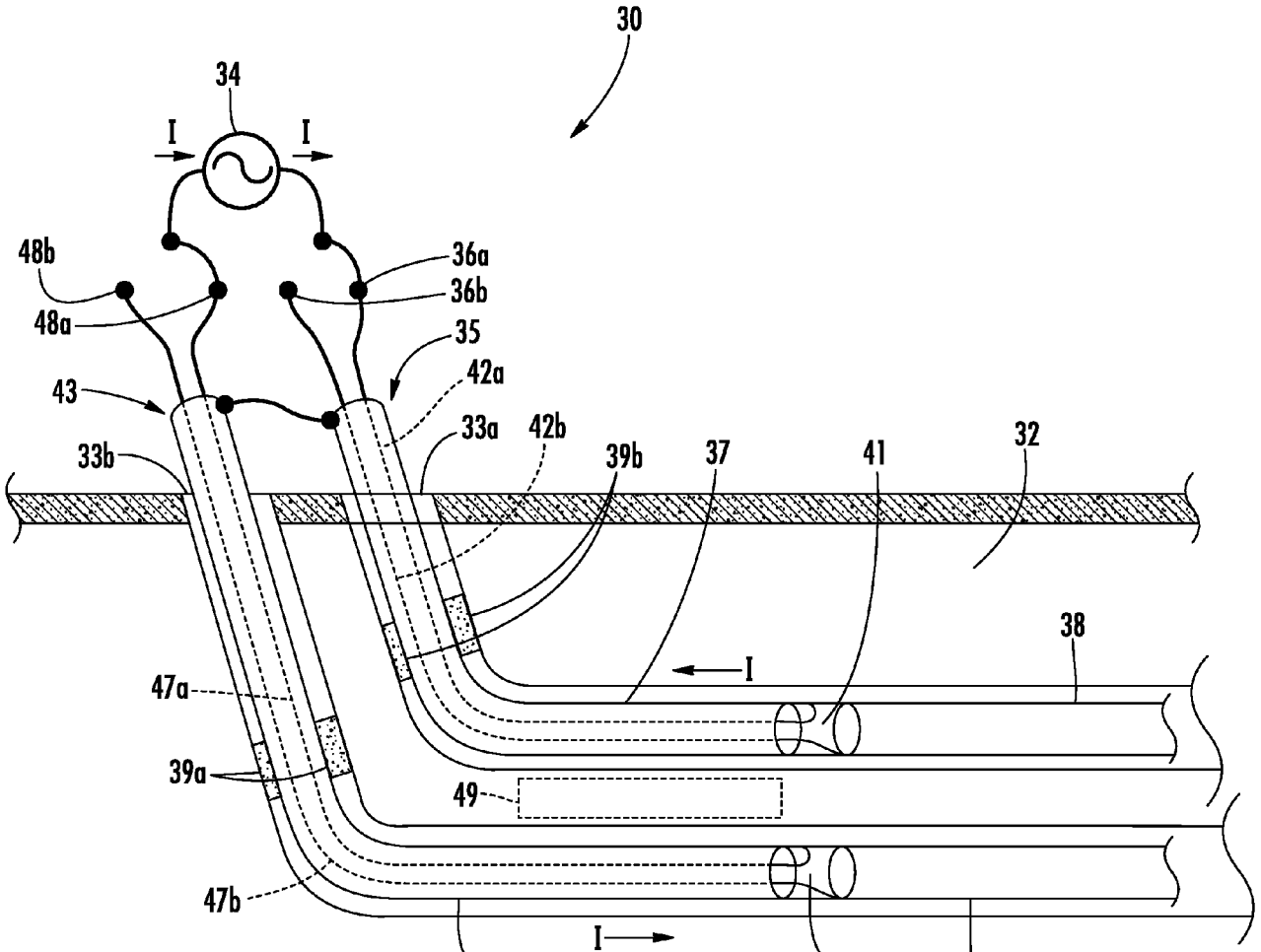
FIG. 6 is a schematic diagram of the apparatus of FIG. 1 coupled in a left slot mode arrangement.

With respect to FIG. 6, the RF source 34 is coupled to one of the first terminals 36*a* and one of the second terminals 48*a* and thus, the first feed conductors 42*a*, 47*a* of the upper and lower wellbores 35, 43. The upper wellbore proximal tubular conductor 37 is coupled to the lower wellbore proximal tubular conductor 44 above the subterranean formation 32.

The upper wellbore RF radiator 35, and in particular, the proximal tubular conductor 37 heats the hydrocarbon resource therebelow, as illustrated by heat pattern 49. The lower wellbore RF radiator 43, and in particular, the proximal tubular conductors 44 heats the hydrocarbon resource thereabove, as illustrated by heat pattern 49. In other words, the hydrocarbon resource in the subterranean formation between the proximal tubular conductors in the upper and lower laterally extending wellbores 33*a*, 33*b* is heated.

Current I flows along the upper wellbore proximal tubular conductor 37 away from the upper wellbore feed point 41. Current I flows along the lower wellbore proximal conductor 44 toward the lower wellbore feed point 46. The apparatus 30 may be considered to be operating in a left slot mode.

Figure 7:
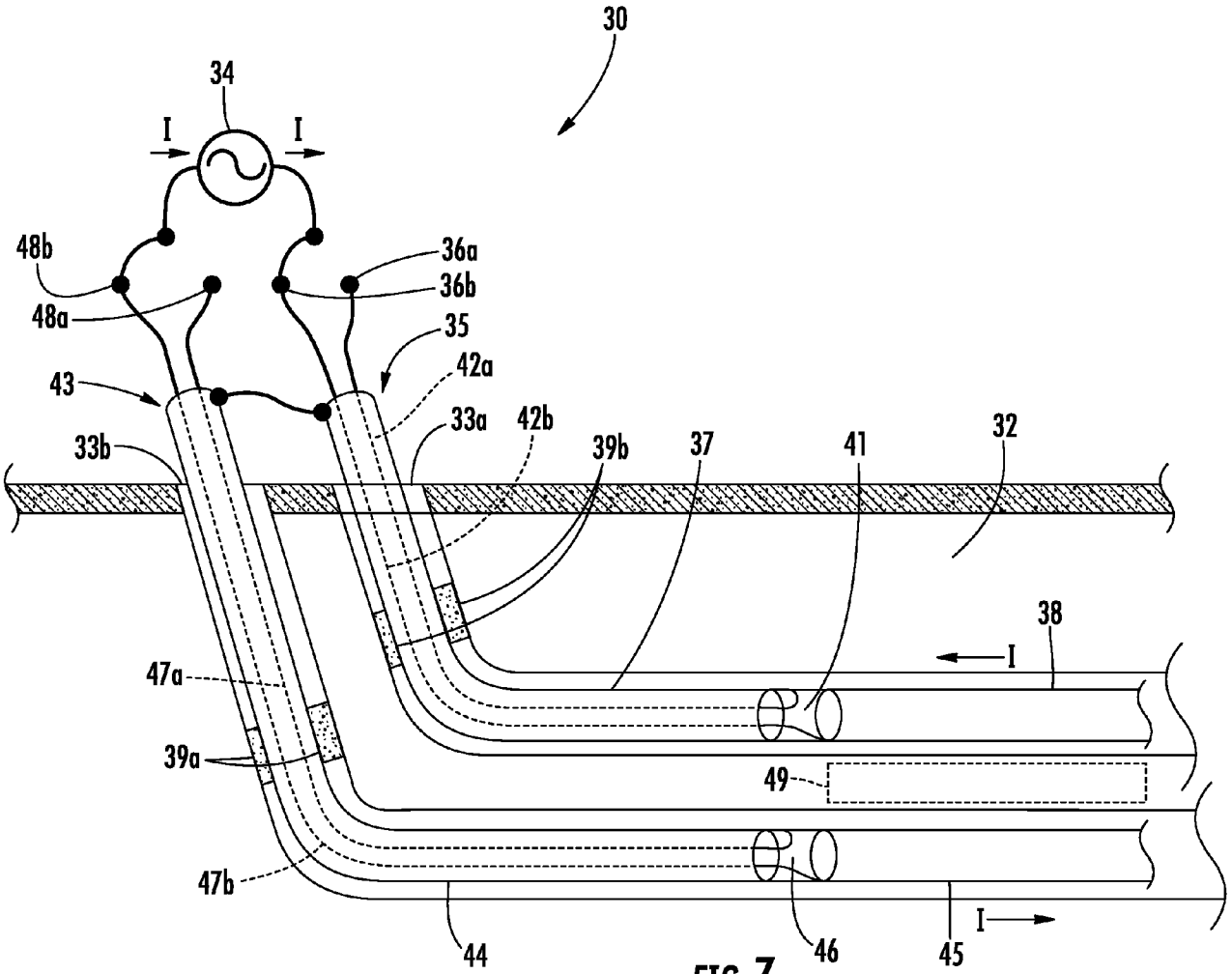
FIG. 7 is a schematic diagram of the apparatus of FIG. 1 coupled in a right slot arrangement.

With respect to FIG. 7, the RF source 31 is coupled to another one of the first terminals 36*b* and another one of the second terminals 48*b* and thus, the second feed conductors 42*b*, 47*b* of the upper and lower wellbore conductors 35, 43. The upper wellbore proximal tubular conductor 37 is coupled to the lower wellbore proximal tubular conductor 44 above the subterranean formation 32.

The upper wellbore RF radiator 35, and in particular, the distal tubular conductor 38 heats the hydrocarbon resource therebelow, as illustrated by heat pattern 49. The lower wellbore RF radiator 43, and in particular, the distal tubular conductor 45 heats the hydrocarbon resource thereabove, as illustrated by heat pattern 49. In other words, the hydrocarbon resource in the subterranean formation 32 between the distal tubular conductors 38, 45 in the upper and lower laterally extending wellbores 33*a*, 33*b* is heated.

Current I flows along the upper wellbore distal tubular conductor 38 away from the upper wellbore feed area 41.

Current I flows along the lower wellbore distal tubular conductor 45 toward the lower wellbore feed point 46. The apparatus 30 may be considered to be operating in a right slot mode.

Figure 8:
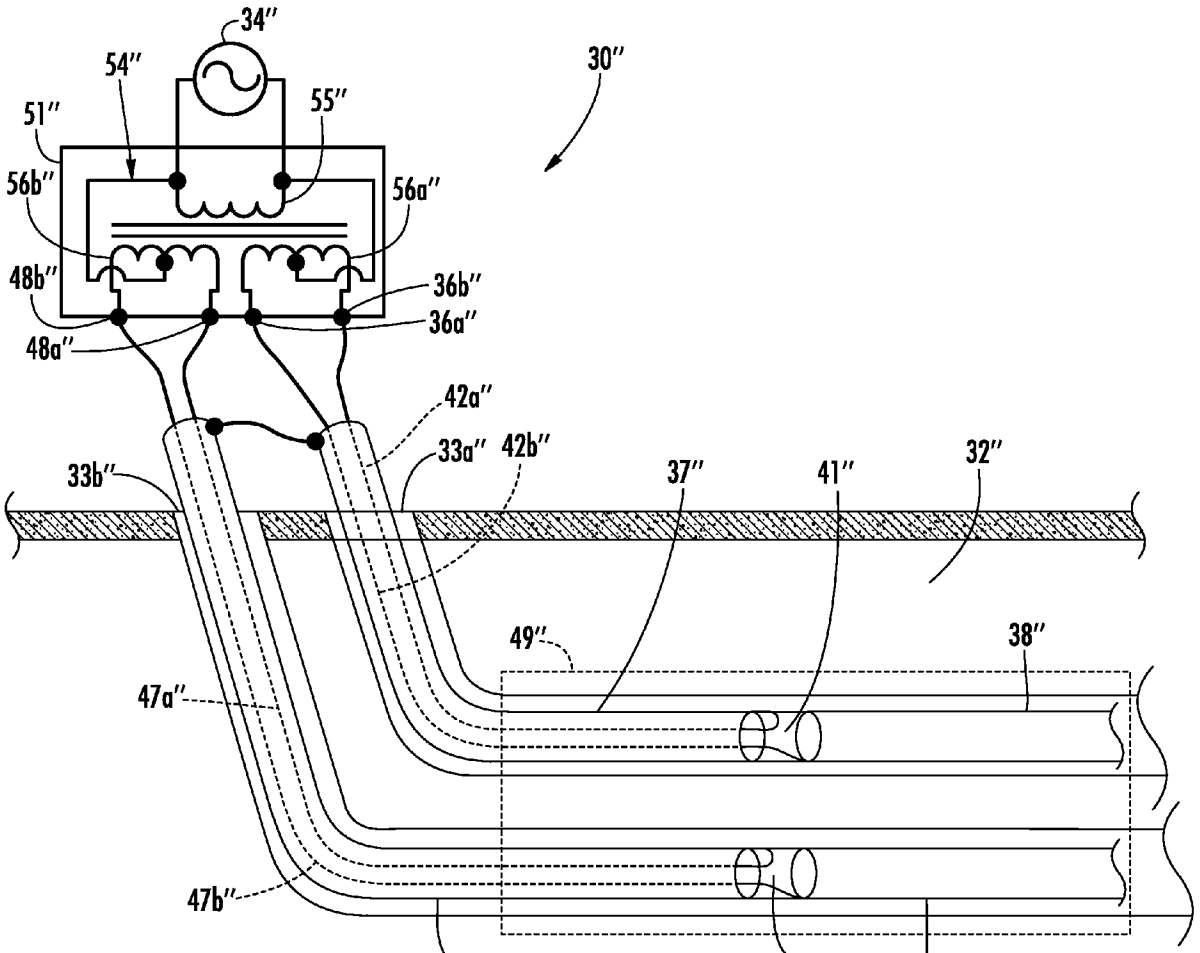
FIG. 8 is a schematic diagram of an apparatus for heating a hydrocarbon resource in accordance with another embodiment of the present invention.

Referring now to FIG. 8, in another embodiment, the interconnection arrangement 51" includes a transformer 54" coupled to the RF source 31" and the first and second terminals 36", 38". More particularly, the transformer 54" includes a primary winding 55" coupled to the RF source 34".

A first secondary winding 56*a*" is coupled to the first terminals 36", and a second secondary winding 56*b*" is coupled to the second terminals 48". Thus the first and second feed conductors 42*a*", 42*b*" of the upper wellbore RF radiator 35" are coupled to the first secondary winding 56*a*", and the first and second feed conductors 47*a*", 47*b*" of the lower wellbore RF radiator 43" are coupled to the second secondary winding 56*b*". The upper wellbore proximal tubular conductor 37" is not coupled to the lower wellbore proximal tubular conductor 44" above the subterranean formation 32".

The upper wellbore RF radiator 35", and in particular, the proximal and distal tubular conductors 37", 38", heats the hydrocarbon resource above and below the laterally extending upper wellbore 33*a*", as illustrated by heat pattern 49". The lower wellbore RF radiator 43", and in particular, the proximal and distal tubular conductors 44", 45", heats the hydrocarbon resource above and below the laterally extending lower wellbore 33*b*", as illustrated by heat pattern 49". In other words, the hydrocarbon resource in the subterranean formation 32" above and below the proximal tubular conductors 37", 44" in the upper and lower laterally extending wellbores 33*a*", 33*b*" is heated. The apparatus 30" may be referred to as operating in a combined dipole panel and dipole slot mode according to Babinet's Principle, depending on whether the electric currents on the upper and lower laterally extending wellbores 33*a*", 33*b*" are in parallel or anti-parallel. Table 1, below summarizes the above-described arrangements and embodiments.

TABLE 1

| Driven Terminals | Heat Concentration | Type Of Antenna Mode Realized | Type Of Transmission Line Mode Realized | Comments |
|---|---|---|---|---|
| 36a to 36b | Upper wellbore | Upper wellbore becomes a dipole | Common (parallel currents on well bores) | Important RAGD |
| 48a to 48b | Lower wellbore | Lower wellbore becomes a dipole | Common (parallel currents on well bores) | Important RAGD |
| 36a to 48a | Between wellbores Left | Up feed regions of both wellbores become a skeleton slot | Differential (anti-parallel currents on well bores) | Important SAGD start up |
| 36b to 48b | Between wellbores Right | Down feed regions of both wellbores become a skeleton slot | Differential (anti-parallel currents on well bores) | Important SAGD start up |
| 36a and 36b shorted, to 48a and 48b shorted | Between wellbores | Both wellbores become a skeleton slot | Differential (anti-parallel currents on well bores) | Important SAGD startup, initiates convection |
| Hybrid circuit (FIG. 8) | Between, above and below | Both wellbores become a skeleton slot and a dipole | Differential and common (parallel and anti-parallel currents on well bores) | Greatest penetration |

It is understood that the "Type of Transmission Line Mode Realized" column in Table 1 is a figurative analogy to the upper and lower laterally extending wellbores 33*a*", 33*b*" being akin to an open wire transmission line. Of course the upper and lower laterally extending wellbores 33*a*", 33*b*" are not open wire transmission lines and they dissipate near and far RF electromagnetic fields in the subterranean formation 32" to provide RF heating.

Figure 9:
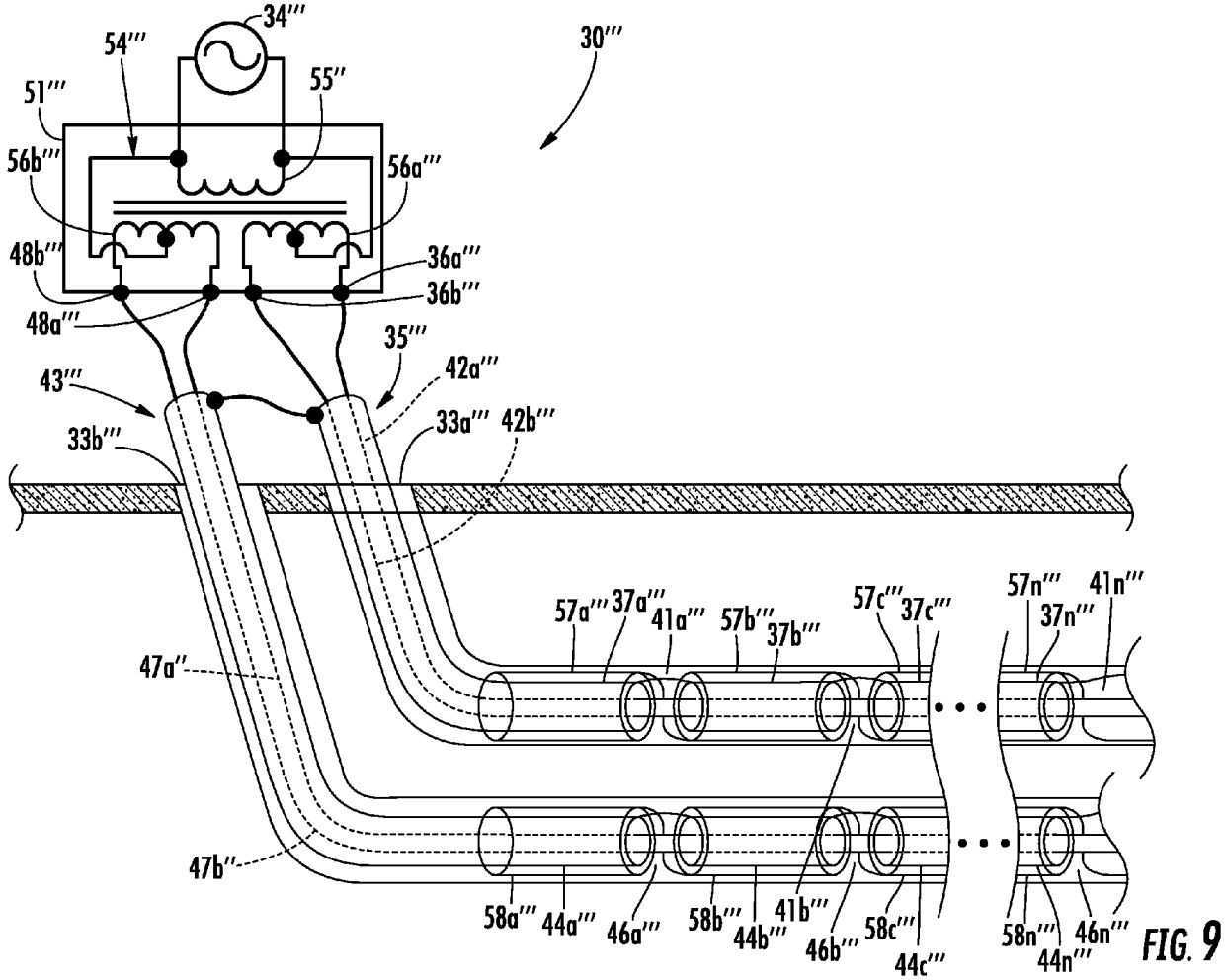
FIG. 9 is a schematic diagram of an apparatus for heating a hydrocarbon resource in accordance with another embodiment of the present invention.

Referring now to FIG. 9, in another embodiment, the upper wellbore RF radiator 35'" illustratively includes a series of tubular conductors 37*a*'"-37*n*'" arranged in end-to-end relation. The upper wellbore RF radiator 35'" also includes a series of sleeves 57*a*'"-57*n*'" surrounding the tubular conductors 37*a*'"-37*n*'" and also arranged in end-to-end relation.

The upper wellbore RF radiator 35'" also includes first and second feed conductors 42*a*'", 42*b*'" extending through the series of tubular conductors 37*a*'"-37*n*'". The sleeves 57*a*'"-57*n*'" advantageously reduce the amount of currents on the first and second feed conductors 42*a*'", 42*b*'", or transmission lines.

The first and second feed conductors 42*a*'", 42*b*'" of the upper wellbore are coupled to the series of sleeves 57'". In particular, the first feed conductor 42*a*'" is coupled to the first outer sleeve 57*a*'" at a first feed area 41*a*'". The second feed conductor 42*b*'" is coupled to the second outer sleeve 57*b*'" also at the first feed area 41*a*'". The first and second tubular outer conductors 37*a*'", 37*b*'" are coupled to each other at the first feed area 41*a*'". The first feed conductor 42'" is also coupled to the second outer sleeve 57*b*'" at a second feed area 41*b*'". The second feed conductor 42*b*'" is coupled to the third outer sleeve 57*c*'" also at the second feed area 41*b*'". The second and third tubular outer conductors 37*b*'", 37*c*'" are coupled to each other at the second feed area 41*a*'". This coupling arrangement continues on for each of the series of tubular conductors 37'" and sleeves 57'".

The lower wellbore RF radiator 43'" also illustratively includes a series of tubular conductors 44*a*'"-44*n*'" arranged in end-to-end relation. The lower wellbore RF radiator 43'" also includes a series of sleeves 58*a*'"-58*n*'" surrounding the tubular conductors 44*a*'"-44*n*'" and also arranged in end-to-end relation.

The lower wellbore RF radiator 43'" also includes first and second feed conductors 47*a*'", 47*b*'" extending through the series of tubular conductors 44*a*'"-44*n*'". The sleeves 58*a*'"-58*n*'" advantageously reduce the amount of currents on the first and second feed conductors 47*a*'", 47*b*'", or transmission lines.

The first and second feed conductors 47*a*'", 47*b*'" of the lower wellbore 33*b*'" are coupled to the series of sleeves 58'" in a similar arrangement as the upper wellbore first and second feed conductors. In particular, the first feed conductor 47*a*''' is coupled to the first sleeve 58*a*''' at a first feed point 46*a*''', the second feed conductor 47*b*''' is coupled to the second outer sleeve 58*b*''' also at the first feed point 46*a*''', the first and second tubular outer conductors 44*a*''', 44*b*''' are coupled to each other at the first feed point 46*a*''', and so on.

Similar to the embodiment described above with respect to FIG. 8, the interconnection arrangement 51''' includes a transformer 54''' coupled to the RF source 34''' and the first and second terminals 36''', 48'''. More particularly, the transformer 54''' includes a primary winding 55''' coupled to the RF source 31'''.

A first secondary winding 56*a*''' is coupled to the first terminals 36''', and a second secondary winding 56*b*''' is coupled to the second terminals 48'''. In this way, portions of the upper and lower wellbore RF radiators 35''', 43''' may switched to heat desired areas of the subterranean formation 32'''.

Figure 10B:
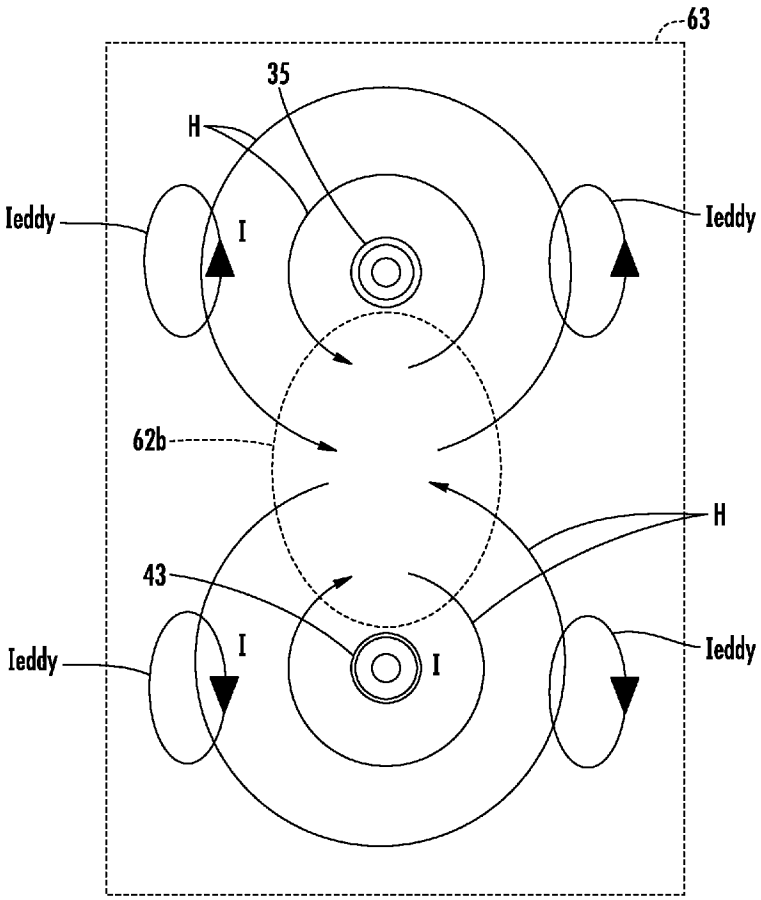
FIGS. 10*a* and 10*b* are simulated electromagnetic heating diagrams of a hydrocarbon heating apparatus according to the present invention.
Figure 10A:
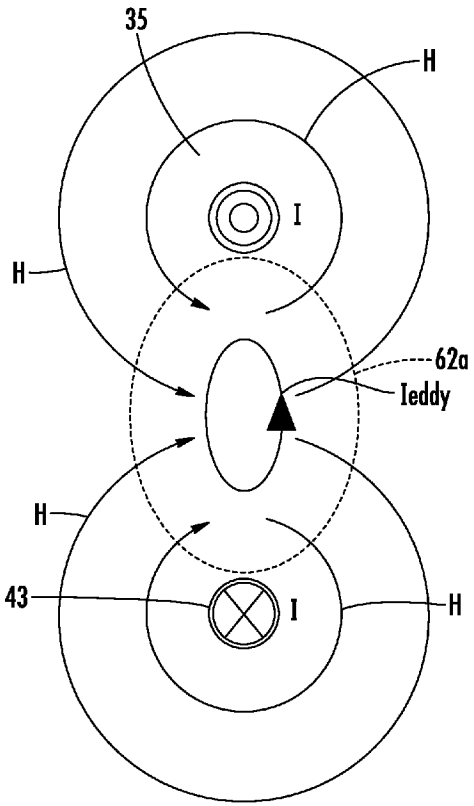

Referring now to FIGS. 10*a* and 10*b*, electromagnetic heating diagrams of a cross-sectional view of the hydrocarbon heating apparatus are illustrated. FIG. 10*a* illustrates anti-parallel current flows on the upper and lower wellbore RF radiators 35, 43. The upper wellbore RF radiator 35 has current coming out of the page, and the lower wellbore radiator 43 has the RF current oriented into the page, hence the dot and X symbols of vector notation. These currents I cause magnetic near fields H to curl around the upper and lower wellbore RF radiators 35, 43 wellbores according to Amperes Law. The magnetic near fields aid each other in the interwell region 62*a* so they combine to concentrate RF heating there.

Magnetic near fields H cause heating by causing eddy electrical currents $I_{eddy}$ in the conductive water in the subterranean formation. The eddy electrics $I_{eddy}$ curl according to according to Lentz' Law and they dissipate themselves as heat due to Joule Effect. Thus, there is a compound heating mechanism, i.e. induction heating, where the currents of the upper and lower wellbore RF radiators 35, 43 cause magnetic near fields that combine constructive to heat preferentially between the upper and lower wellbore RF radiators 35, 43. Increasingly reliable electrical resistance heating is formed deep in the subterranean formation so that liquid water electrode contact between the wellbores and the subterranean formation may not be desired, although there may conductive electrode contact if so desired.

FIG. 10*b* illustrates the upper wellbore radiator 35 and the lower wellbore radiator 43 conveying parallel electric currents due to changed switch throws on the surface. The magnetic near fields H now have opposing senses in the interwell region 62*b*. Because of the opposing magnetic near field, eddy electric currents may not form in the interwell region 62*b* and little to no RF heating occurs there. Instead RF heating is spread away from the interwell region 62*b* and into the surrounding area 63. Accordingly, changing the orientations of the electric currents on the upper wellbore RF radiator 35 and the lower wellbore RF radiator 43 may provide concentrated interwell region heating 62*a* for startup of convection, and thereafter the area 63 can be heated for long term production using the same underground structures.

Although the embodiments are not limited to operating the RF source 34 at specific RF frequency range, analysis and testing has shown that those frequencies between about 1 KHz and 10 MHz may have increased utility. Too low of a frequency may reduce the electrical load resistance obtained, for example, for 60 Hz operation uneconomic conductor gauges may be used. Too high of a frequency may unnecessarily reduce the prompt penetration of the RF heating energies axially along the upper wellbore radiators. In fact, the hydrocarbon heating apparatus 30 may advantageously heat over a broad frequency range as operation at molecular resonance frequencies of any of the subterranean molecules may not be needed. Operation at natural resonance of the upper and lower wellbore RF radiators may even be preferential. For example, and for many specific conditions, the resonance frequency of a bare metal pipe 1 kilometer wellbore radiator in rich Athabasca oil sand having electrode-like contact with the connate water is a broad frequency band near 2 MHz.

A general theory of RF heating will now be described. The embodiments advantageously provide formation RF heating by creating one or more of radio frequency 1) electric currents, 2) electric fields, and 3) magnetic fields in the subterranean formation. These radio frequency energies are then dissipated as heat. The radio frequency heating may be preferred over other forms of heating as there is increased speed, penetration, and control. More specifically, the upper and lower wellbore RF radiators 35, 43 may, alone, and in combination, generate as many as eight different radio frequency energy and field types:

a. Conducted electric currents (electrode, conductive contact);
b. Radial electric near fields (capacitive coupling);
c. Circular electric near fields (capacitive coupling);
d. Circular magnetic near fields (magnetic induction coupling);
e. Electric middle fields;
f. Magnetic middle fields;
g. Electric far fields (a radiated radio wave component); and
h. Magnetic far fields (a radiated radio wave component).

Thus, the present embodiments may provide multiple mechanisms of the RF heating and can more reliably provide the heat with or without contact with liquid water contact in the subterranean formation.

Initially, the hydrocarbon ore may be heated by joule effect by the conduction of radio frequency electrical currents, e.g. the lower wellbore RF radiator 43 and/or the upper wellbore RF radiator 35 act as electrodes. Later the water in the underground formation close to the antenna may become steam so that conductive electrode contact is lost between the RF radiators and the underground formation. The RF heating is then contained with reduced liquid water contact by 1) induction of eddy electric currents in the formation as the upper and lower wellbore RF radiators 35, 43 generate magnetic near fields, and by 2) displacement currents to capacitively couple electrical current into the formation.

The RF heating, especially at elevated radio frequencies, may also be accomplished by dielectric heating of the formation molecules, especially pore water molecules. By any of the electromagnetic heating mechanisms, liquid pore water in subterranean formations generally heats much faster than the sand, shale, or hydrocarbons in the matrix. In Athabasca Oil Sand, for instance, the microstructure may include a sand grain, a water pore around the sand grain, and a bitumen film around the water pore.

Thus, the radio frequency electromagnetic energies may penetrate near the speed of light to heat the connate pore water in the subterranean hydrocarbon formation, and the heated pore water may then heat the pore wall hydrocarbons conductively. Water and bitumen may be produced together after warming by the RF energies. The speed of RF heating can be much faster than steam convection heating or conducted heating, and this can increase the speed of well hydrocarbon production several fold, resulting in increased present value and profit.

A scale model test of an embodiment of the invention was conducted in a glass sided water tank. Salt water was used to faithfully emulate the electrical properties of a subterranean hydrocarbon ore by electromagnetic scaling rules, e.g. the apparatus 30 was tested by in scale by reducing physical size, raising frequency, and increasing the electrical conductivity of the media to be heated.

Two 32-gaure bare brass wires were used to emulate the upper wellbore RF radiator 35 and the lower wellbore RF radiator 43. The wires had an outer diameter of 0.008 inches and were stretched across the tank and were separated by 0.175 inches, center-to-center.

Figure 11:
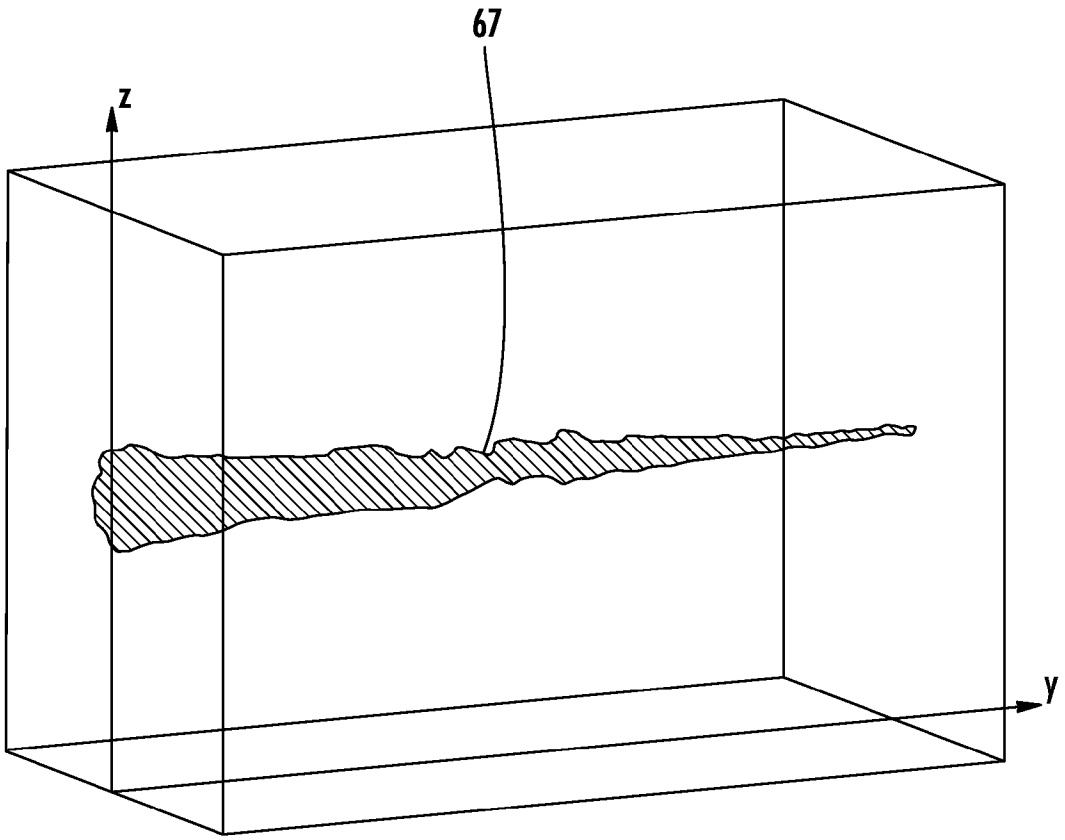
FIG. 11 is a heating diagram of a conceptual prototype apparatus.

Referring additionally to the graph in FIG. 11, a specific absorption rate (SAR field) pattern in watts per meter cubed for a heated area 67 is illustrated. The power applied by the RF source was 1 watt. The water bath was seawater of 5 mho/meter electrical conductivity and the radio frequency was 6.78 MHz. The RF skin depth in the 5.0 mho/meter sea water at 6.78 MHz is 3.4 inches and a computer simulated for the heating pattern matched the physically tested and measured SAR heating rate pattern. The axial penetration of the heating energy was similar to the canonical RF skin depth in a conductor. More particularly, the 1/e depth of the axial heating energy penetration was 3.4 inches and practically no heating energy was seen at about 20 inches The heated area 67 is concentrated between and around the two brass wires and tapers off relative to the location where the power is supplied to the brass wires at the side of the glass tank.

A 5 mhos/meter water tank at 6.78 MHz is a 2500:1 scale model of a full scale well RF heating system operated in 0.002 mho/meter conductivity oil sand at a full scale frequency of 27.1 Kilohertz. This is because frequency scales linearly with subterranean formation conductivity and 6.78 (0.002/5.0)=2500 to 1. So a 1 kilometer long RF heating system was computer modeled, and physically built and tested at physical scale with predicted results matching theoretical and simulated for results.

A small scale conceptual prototype apparatus similar to that described above with respect to FIG. 1 was built. The prototype apparatus was about a 2500:1 scale model and operated in the slot mode, as described above with respect to FIG. 5. A tank that measured 20 inches in length, 12 inches in depth 10 inches in depth was used for simulation of the subterranean formation.

A high-frequency (HF) oscillator and a 2 KW HF amplifier were coupled to a reflectometer or directional coupler that measures incident and reflected RF power to and from the brass wires, or antenna. An impedance matching network was also coupled to the reflectometer. An RF ammeter was coupled between the reflectometer and the tank that included that brass wires. Application of 1400 Watts of RF power to a water bath that simulates ore, or the hydrocarbon resource in the subterranean formation, at 5 Mho/Meter at 6.78 MHz, showed visible boiling and convection.

Diffused tiny steam bubbles were seen in the water and the steam bubble pattern was identical to the simulated for SAR heating contours. Nucleate boiling on the bottom of the water tank was not observed, so the RF energy had penetrated the water and was heating the water from within the water, e.g. the heating obtained was not conducted heating but rather penetrative RF heating. Later, film boiling was observed on the brass wires as the water tank temperature approached 100° C. The RF heating was continued during the field boiling period by adjusting inductors and capacitors in a PI topology RF impedance matching network, connected between the transmitter and the water tank. During film boiling the RF energy was coupling into the water by magnetic field induction of eddy currents into the water and also by electric field displacement current capacitive coupling. Prior to film boiling there were also conducted RF electric currents in the water from the surfaces of the uninsulated brass wires, resulting somewhat lower RF circuit impedances. So the RF heating was reliable with and without liquid water contact with the scale model well heater/brass wires.

Florida soil was then used to emulate the hydrocarbon ore in the glass tank. Prior to RF heating, the soil had an effective relative permittivity of 12 Farads/meter squared, and a conductivity of 0.002 Mhos/meter at 6.78 MHz. The conductivity in the Florida soil is due to dissolved carbon dioxide from the water in soil as the water falls as rain in the atmosphere picking up atmospheric $CO_2$. A uniform color of the soil was observed initially and color shows soil temperature, above and below boiling temperature. 1400 Watts of RF power at 6.78 MHz was applied to the brass wires. At an intermediate time, for example, 6 minutes of heating, a steam bubble could be observed closest to the terminals. The heating front, or where steam could be observed, was conical in the soil and (a light triangular area looking through the viewing glass) in shape with the base closest to the terminals. In the heating front, the ore appears light where steam occurred because the water did not wet the glass. In other words, the farther away from the terminals, the less steam was observed. After approximately 20 minutes, or completion of the RF heating, the entire tank had reached a temperature of 100° C. It should be noted that the RF heating continued after all the liquid water contact was lost.

Thus, a conical steam bubble or steam saturation zone moved along the scale model RF well heater/brass wires. There as about a 3 to 1 increase in electrical impedance when liquid water contact was lost with the water in the soil and this was easily managed in the test by increasing the value of a parallel inductor in the impedance matching network, when the water boil off occurred.

Similar parallel brass wire scale models of the present embodiments have been used to heat actual samples of Athabasca oil sands in glass tubes. In the scale model production tests RF heating of the ore was accomplished and bitumen and water were produced together by RF from the oil sand sample. A pump provided the driving forces to mobilize the RF warmed water and bitumen, as well as by other methods. RF production rates were significantly higher to control tests using steam injection heating. Production could be increased by a factor of 3 to 1 over steam significantly increasing present value of the produced bitumen. The bitumen recovery factor from the ore was positive as well. RF produced bitumen was better than the steam produced bitumen as the RF produced bitumen was reduced in viscosity and upgraded relative steam produced bitumen. In particular, RF reduced the aromatic content by converting most of the aromatic molecules to polar molecules.

Figure 12A:
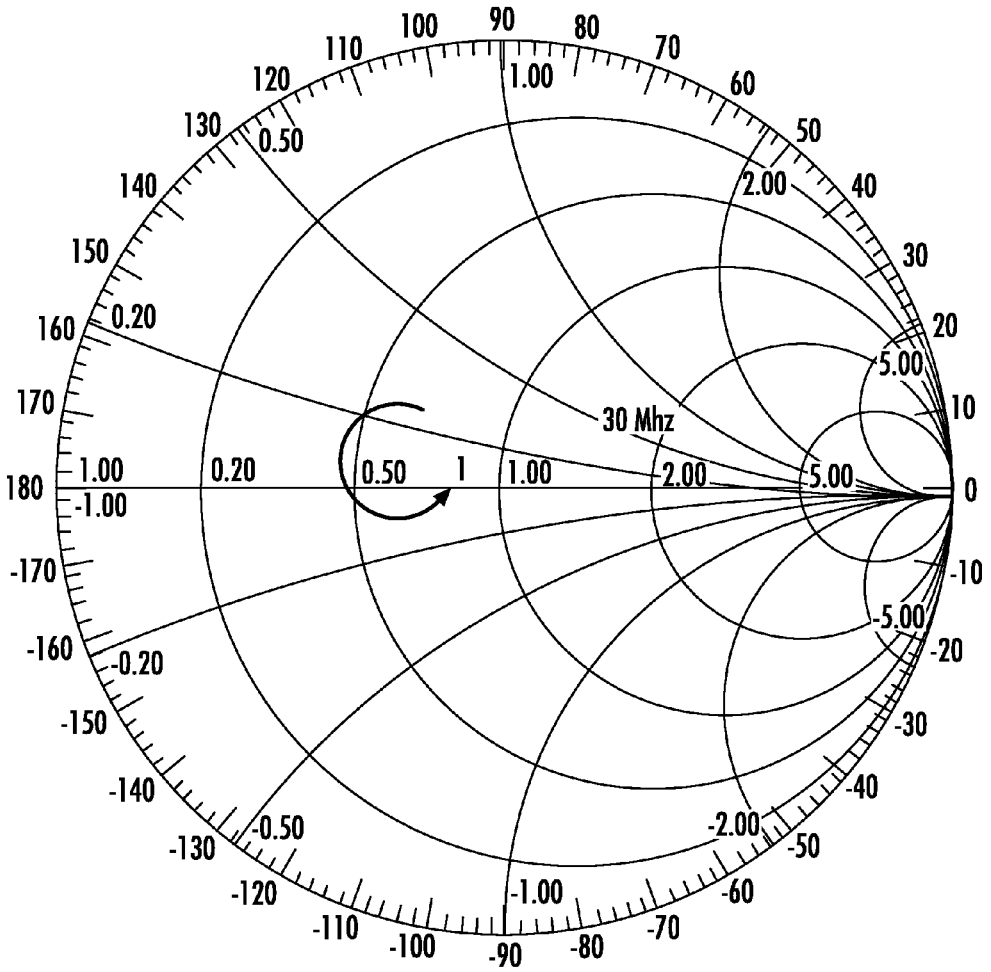
FIGS. 12*a* and 12*b* are Smith charts of simulated and measured driving point impedance of the conceptual prototype apparatus.
Figure 12B:
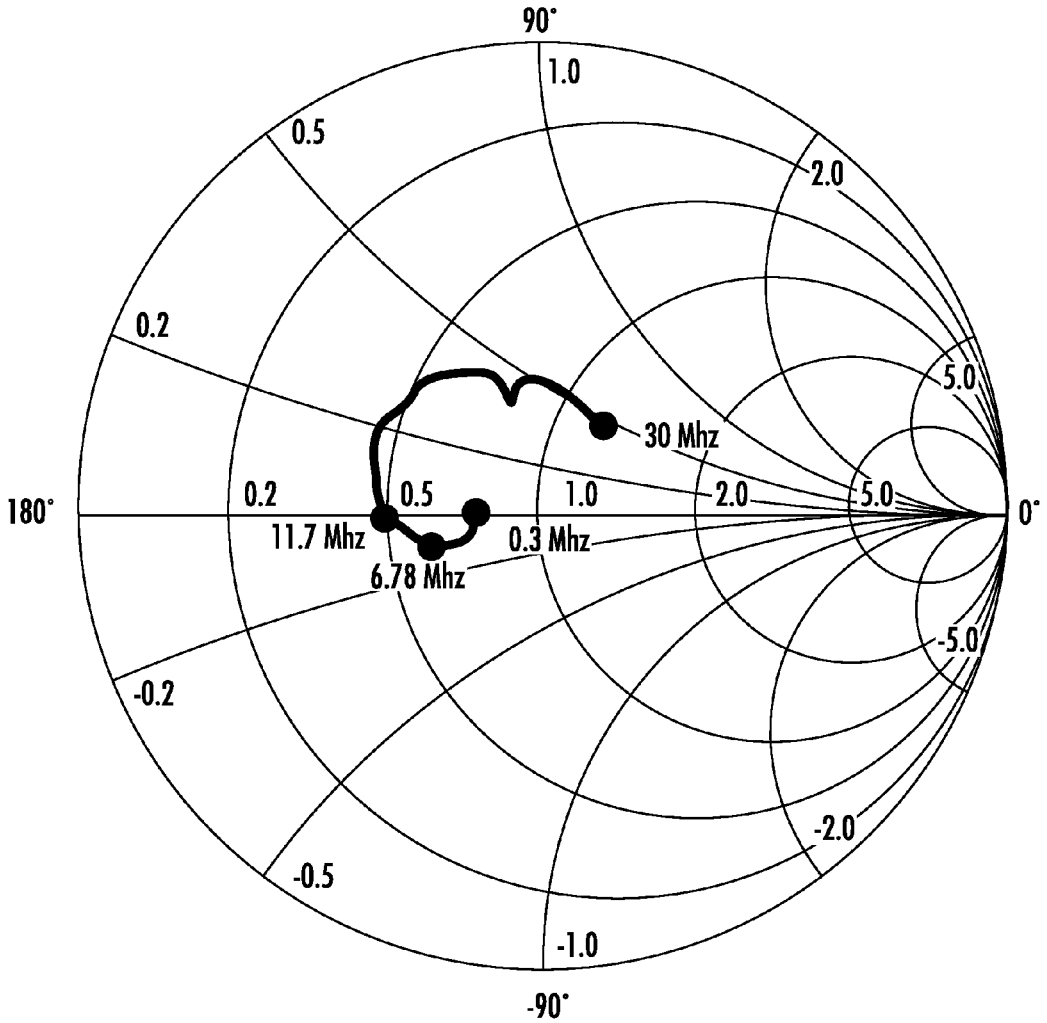

Referring now additionally to the Smith charts in FIGS. 12*a* and 12*b*, simulated and measured results for the conceptual prototype apparatus including a 5 Mho/meter water bath are illustrated, respectively. As will be appreciated by those skilled in the art, the impedance is resonant, thus, making the heating relatively efficient. The results are summarized in Table 2 below.

TABLE 2

| Parameters | Simulated 6.78 MHz | Measured 6.78 MHz | Difference |
|---|---|---|---|
| Resistance | 31.9 Ω | 30.1 Ω | −5.6% |
| Reactance | 5.2 | 4.5 | −13.4% |

A pilot model of an embodiment was tested in a manmade hill of Florida soil in Malabar, Fla. Florida soil is similar electrically to rich Athabasca oil sand, so the underground heating of a hydrocarbon reservoir was emulated. The soil hill measured about 50 by 200 feet at the base and reaching a height of 18 feet and it was measured to have a relative permittivity of 6 and an electrical conductivity of about 0.0015 mhos/meter. One (1) single wellbore radiator was used throughout the test, so only one well hole was used. The RF heated section of the single wellbore radiator was 64 feet long so the electrical choke was 64 feet from the distal end of the wellbore radiator.

The feed area was about 32 feet from the distal end of the wellbore radiator so the RF heating section was fed in the center. The RF power source was a tetrode vacuum tube transmitter manufactured by Continental Electronics of Dallas, Tex., USA. It provided 140 kilowatts of average power at a radio frequency of 6.78 MHz. This corresponds to 2.19 kilowatts of RF power being applied per foot of wellbore radiator. The length of the heating period of 21 was days, with short breaks for measurements and inspections. The heating was reliable throughout the period and there was no electrical contact required between the wellbore radiator and the soil moisture. In fact the wellbore radiator was operated in a nonconductive conduit to enforce this.

Figure 13A:
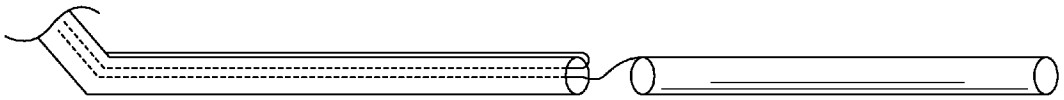
FIGS. 13*a*-13*d* are simulated heating pattern diagrams based upon a conceptual prototype apparatus.

Referring to FIGS. 13*a*-13*d* the realized temperatures or heating patterns in the soil at various times will be described. FIG. 13*a* illustrates the wellbore radiator prior to the application of RF power. The soil was at a uniform temperature of 74 degrees Fahrenheit. Initially, when RF power was first applied, heating near the ends of the wellbore radiator occurred by capacitive coupling of electric near fields to the soil, e.g. displacement currents RF heating at the ends of the antenna. There was also initial heating near the feed area by both electric near fields/displacement currents and induction.

Figure 13B:
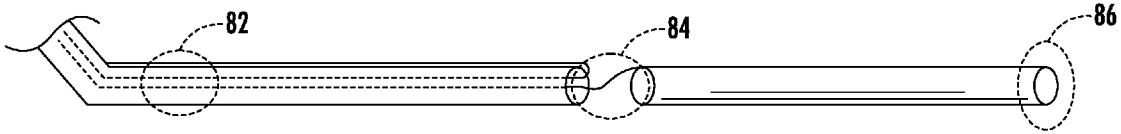
Figure 13C:
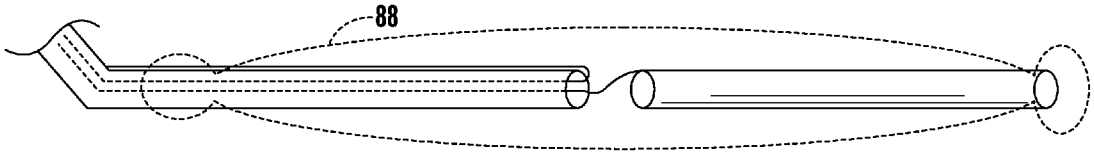

FIG. 13*b* illustrates the realized temperatures after two days of the RF heating, and at that time three hotspots 82, 84, 86 had formed. The three hotspots 82, 84, 86 quickly reached the boiling point of water at sea level. After 1 week of RF heating a football shaped temperature pattern 88 formed as illustrated in FIG. 13*c*, so heating occurred along the entire portion of the wellbore RF radiator. In embodiments where an electrical choke is used, heating occurs along the entire portion of the wellbore RF radiator distal the electrical choke.

The football shaped heating pattern 88 was caused by the magnetic near fields of the wellbore radiator, and those magnetic near fields caused induction of eddy electric currents in the formation which dissipated as heat by joule effect. In fact, magnetic near field induction heating quickly became the predominant electromagnetic heating mechanism for most of the test.

Figure 13D:
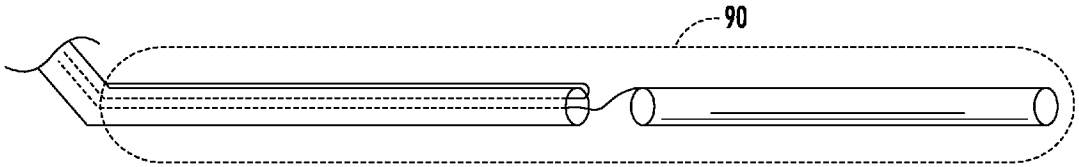

Ultimately, as shown in FIG. 13*d* a nearly cylindrical shaped steam saturation zone 90 formed around the wellbore radiator, so the wellbore radiator formed a cylindrical "steam bubble" around itself so to speak. The heating patterns were confirmed by buried temperature sensors and infrared pictures of the hill. The temperature inside the steam saturation zone(s) was uniform and about 99 degrees Fahrenheit.

The cylindrical shaped steam saturation zone 90 was continuing to grow when the test was concluded, e.g. the RF heating did not stop until the application of RF power was discontinued. The magnetic near fields from the wellbore radiator expanded inside the steam saturation zone 90 and concentrated heating occurred at the wall of the steam saturation zone where liquid phase water was present.

Thus, an expanding thermal front was created and the steam zone allowed the magnetic near fields to expand to reach the steam saturation zone wall without significant dissipative losses. The thermal gradient at the wall of the steam saturation zone could be controlled by adjusting the applied RF power level of the RF source. Much less aggressive RF heating rates are of course possible by reducing the RF power, and including conduction and convection effects, to say to warm an underground formation deeply.

After the test, visible amounts steam could be released by digging into the hill with a shovel. Of course, lower levels of radio frequency power could have been applied in which case the hill would have reached lower temperatures, or steam saturation zones not created. It may not be desirable to form a steam saturation zone to propagate RF heating, although one may be formed if desired. The wellbore radiator provided a useful 3 to 1 voltage standing wave ratio to the RF source throughout the test. The source impedance of the RF power source was 50 ohms.

As the pilot model test demonstrated, embodiments of the present invention can provide relatively rapid penetrating heating in most subterranean formations including sands and hydrocarbon ores. Unlike steam injection methods or SAGD, RF heating does not require a steam plant and it does it require surface water resources. RF energy initiates hydrocarbon driving forces, such as a steam flood, by heating the connate water, and thermal expansion drive forces as well.

The pilot model of the wellbore radiator was later taken from Florida to an oil sand strip mine in Athabasca Province, Canada. There the wellbore radiator was installed in a horizontal borehole in the mine face of oil sand. 49 kilowatts of RF power were delivered to the wellbore radiator at a frequency of 6.78 MHz for a period of 35 days. 64 feet of the borehole was RF heated, which corresponds to the radiating section of the wellbore radiator distal the electrical choke. The horizontal borehole was larger in diameter than the wellbore radiator. As heating progressed between 500 to 800 gallons of oil flooded the vacant portions of the borehole, surrounding the wellbore radiator. In fact, it eventually became necessary to seal the wellbore radiator into the mine face with cement to prevent the spillage of the produced oil. As is typical of RF produced oil, the viscosity of the produced oil was substantially reduced relative to oil produced conventionally. This viscosity reduction continued even after the produced oil had cooled. The RF produced oil was chemically different and more valuable than Clark Hot Water Process bitumen, which oil sand strip mines typically produce.

A method aspect is directed to a method for heating a hydrocarbon resource in a subterranean formation 32 having at least one pair of laterally extending upper and lower wellbores 33*a*, 33*b* therein. The subterranean formation 32 also includes an upper wellbore RF radiator 35 positioned in the laterally extending upper wellbore and including a plurality of first terminals 36, and a lower wellbore RF radiator 43 positioned in the laterally extending lower wellbore, and including a plurality of second terminals 48. The method includes selectively coupling an RF source 34 and the first and second terminals 36, 48 so that at least one of the upper and lower wellbore RF radiators 35, 43 heat the hydrocarbon resource in the subterranean formation 32.

Figure 14:
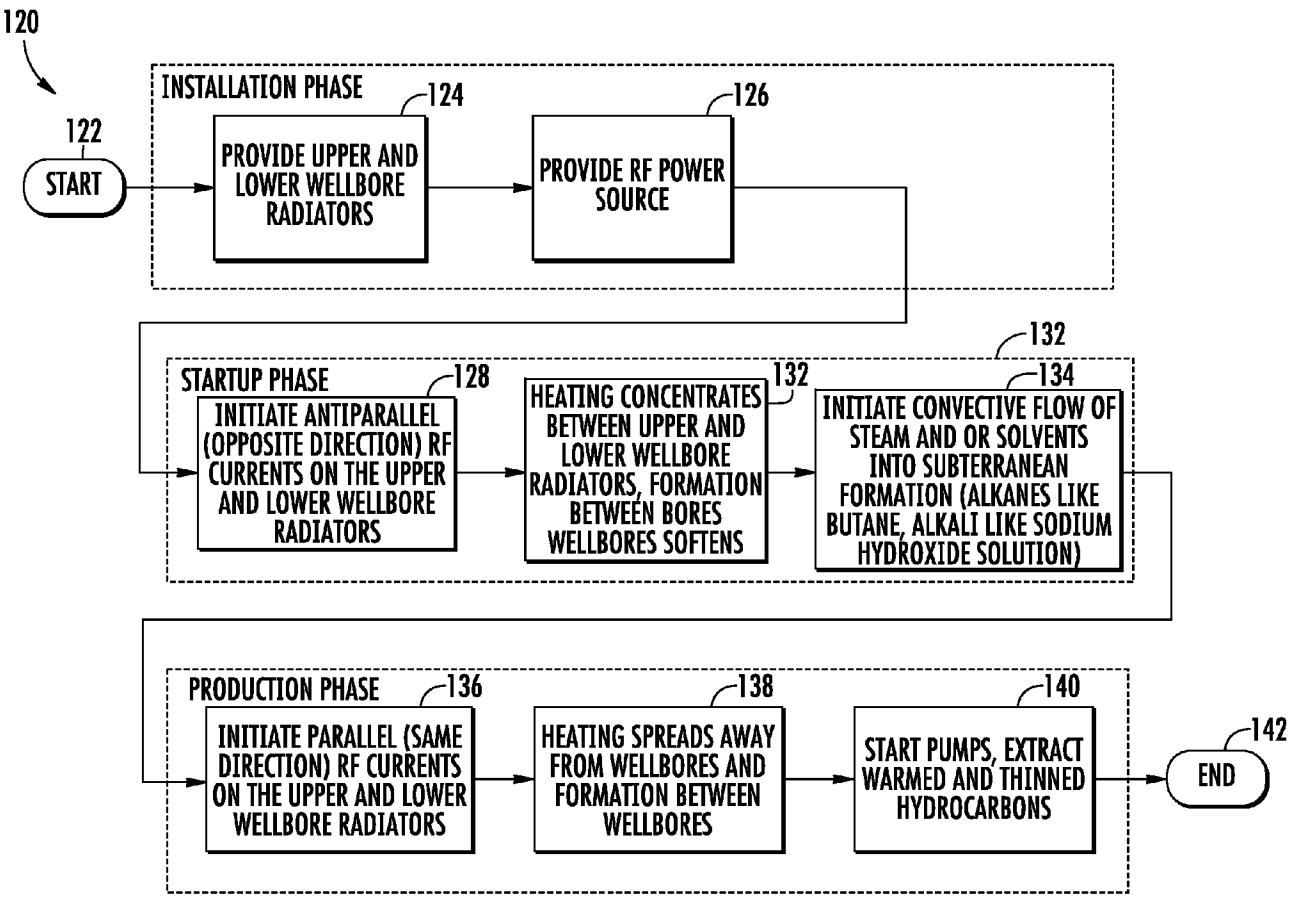
FIG. 14 is a flowchart illustrating a method of starting a hydrocarbon well in accordance with the present invention.

Referring now additionally to FIG. 14, a flow diagram 120 illustrates a more detailed method of heating a hydrocarbon resource. The method may be particularly advantageous for use during startup as it may provide accelerated startup of a Radio Frequency Assisted Gravity Drainage (RAGD) well system, accelerated startup of a SAGD well system, or accelerated startup of a combined RAGD-SAGD system which uses both steam and RF heating. The method may advantageously concentrate RF heating between the upper and lower wellbores 33*a*, 33*b* to soften the subterranean formation 21 to convective flows of oil, water, steam, or injected solvents. During a production phase, the radio frequency heat may be directed away from the region between the upper wellbore RF radiator 35 and the lower wellbore conductors 43 to produce oil from a large underground region.

Starting at Block 122, the method includes, at Block 124 providing an upper wellbore RF radiator 35 and a lower wellbore radiator 43. At Block 126, an RF source 34 is also provided.

A startup phase occurs and anti-parallel RF electrical currents, e.g. opposite direction or differential mode currents, are applied to the upper wellbore RF radiator 35 and the lower wellbore RF radiator 43 (Block 128). Surface connections that cause the anti-parallel wellbore currents may be those as shown in FIG. 5, for example. The anti-parallel wellbore currents concentrate RF energies and RF heating in the region between the wellbores 33*a*, 33*b* and this heating softens up the subterranean formation 32 in the region between the wellbores (Block 132) to help initiate convection.

Convective flow is initiated in the region between the upper and lower wellbore RF radiators 35, 43 by the injection of water, steam, and/or solvents into the subterranean formation 32 (Block 134). Solvents may include, for example, alkanes, such as propane or butane, or surfactants such as alkali, for example, sodium hydroxide. The injection well may be the upper laterally extending wellbore 33*a*, for example.

As the convective flow becomes established and fluids are produced, a production phase follows. In the production phase a new radio frequency heating pattern is synthesized by switching current flows on the upper wellbore radiator 35 and the lower wellbore radiator 43 to be parallel rather than anti-parallel (Block 136). This reduces the RF heating rate between the wellbores and increases the RF heating rates elsewhere. The convective flow between the upper and lower wellbore RF radiators 35, 43 then expands to produce hydrocarbons from larger regions further away from the well bores (Block 138). The production phase may be by RF heating only, steam heating only, RF plus steam heating, and solvents, such as, alkanes may be injected to reduce production temperatures and overall energy costs. The RF heating may provide the thermal energy to vaporize and drive the solvents. Of course, other techniques may be used, and may be used in combination with each other. Pumps may be started (Block 140) to extract hydrocarbon resources. The hydrocarbon driving forces may include one or more of thermal expansion, steam flood displacement drive, and gravity drainage. The method ends at Block 142.

Thus, multiple heating modes, and, in particular, multiple RF heating modes may synergistically prepare the subterranean formation 32 for hydrocarbon production by warming the formation to initiate convective flows. Convection flow may be increasingly difficult to establish by steam injection alone, as conducted heating is typically required to soften the subterranean formation to allow the flow to start. Conducted heating is relatively slow and difficult in hydrocarbon formations. Steam propagation and steam heating patterns may not be controlled, while RF heating patterns can be predicted and controlled. For instance, steam tends to rise while RF does not. RF heating penetrates hydrocarbon formations to heat from within, with a reduced need for conducted heating.

The realized temperatures from RF heating may depend on the applied RF power in watts, the specific heat of the subterranean formation 32, and the duration of the RF heating in days. The realized temperatures from RF heating may be any desired temperature from the connate temperature of the subterranean formation (no heating) to the boiling temperature of water at reservoir conditions, which may be 100 to 300° C. depending on depth, for example. Glassification and coking of the subterranean formations generally do not occur as the RF heating temperature may not exceed the water boiling temperature, e.g. thermal regulation, as steam may not RF heat while liquid water does. Indeed, liquid water generally RF heats 100 or more times faster than steam, hydrocarbons, and sand grains. Hydrocarbon mobility is significantly increased by RF heating so tight formations may produce.

It is understood that the embodiments can be expanded to form larger arrays of underground wellbore radiators, so any number of wellbore radiators may be provided. For instance, there may be 10 or more upper wellbore radiators and 10 or lower wellbore radiators, or even middle wellbore radiators. Additionally, each wellbore radiator may have any number of electrical segments along the wellbore radiator length and any number of insulated conductors inside to power the electrical segments. Parallel and antiparallel current flows may be established between horizontally displaced wellbore radiators as well as vertically displaced radiators. The wellbore radiators may be vertically aligned, horizontally aligned, or at intermediate, slanted angles.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An apparatus for heating a hydrocarbon resource in a subterranean formation having at least one laterally extending wellbore therein, the apparatus comprising:

a radio frequency (RF) source;

a series of tubular conductors arranged in end-to-end relation in the at least one laterally extending wellbore;

a series of conductive sleeves arranged in end-to-end relation and surrounding said series of tubular conductors in spaced relation therefrom and coextensive therewith; and first and second feed conductors extending through said series of tubular conductors and coupled to said series of conductive sleeves.

2. The apparatus according to claim 1, further comprising an interconnection arrangement comprising:

a plurality of switches; and a controller cooperating with said plurality of switches to selectively couple ones of said first and second feed conductors to said RF source.

3. The apparatus according to claim 2, further comprising a transformer coupling said RF source to first and second feed conductors.

4. The apparatus according to claim 1, wherein the at least one wellbore comprises a pair of upper and lower wellbores; and wherein said series of tubular conductors and series of conductive sleeves are configured to be positioned within the upper wellbore.

5. The apparatus according to claim 1, wherein the at least one wellbore comprises a pair of upper and lower wellbores; and wherein said series of tubular conductors and series of conductive sleeves are configured to be positioned within the lower wellbore.

6. The apparatus according to claim 1, wherein the first and second feed conductors comprise a twinaxial cable.

7. The apparatus according to claim 1, wherein the first and second feed conductors comprise a coaxial cable.

8. An apparatus for heating a hydrocarbon resource in a subterranean formation having at least one pair of laterally extending first and second wellbores therein, the apparatus comprising:

a radio frequency (RF) source;

a series of first tubular conductors arranged in end-to-end relation in the first laterally extending wellbore;

a series of first conductive sleeves arranged in end-to-end relation and surrounding said series of first tubular conductors in spaced relation therefrom and coextensive therewith; and a first pair of feed conductors extending through said series of first tubular conductors and coupled to said series of first conductive sleeves;

a series of second tubular conductors arranged in end-to-end relation in the second laterally extending wellbore;

a series of second conductive sleeves arranged in end-to-end relation and surrounding said series of second tubular conductors in spaced relation therefrom and coextensive therewith; and a second pair of feed conductors extending through said series of second tubular conductors and coupled to said series of second conductive sleeves.

9. The apparatus according to claim 8, further comprising an interconnection arrangement comprising:

a plurality of switches; and a controller cooperating with said plurality of switches to selectively couple ones of said first and second pairs of feed conductors to said RF source.

10. The apparatus according to claim 9, further comprising a transformer coupling said RF source to the first and second pairs of feed conductors.

11. The apparatus according to claim 8, wherein the first laterally extending wellbore comprises an upper laterally extending wellbore, and the second laterally extending wellbore comprises a lower laterally extending wellbore.

12. The apparatus according to claim 8, wherein the first and second pairs of feed conductors each comprises a twinaxial cable.

13. The apparatus according to claim 8, wherein the first and second pairs of feed conductors each comprises a coaxial cable.

14. A method for heating a hydrocarbon resource in a subterranean formation having at least one laterally extending wellbore therein, a series of tubular conductors arranged in end-to-end relation in the at least one laterally extending wellbore, a series of conductive sleeves arranged in end-to-end relation and surrounding the series of tubular conductors in spaced relation therefrom and coextensive therewith, and first and second feed conductors extending through the series of tubular conductors and coupled to the series of conductive sleeves, the method comprising:

selectively coupling the first and second feed conductors to a radio frequency (RF) source to heat the hydrocarbon resource in the subterranean formation.

15. The method according to claim 14, wherein selectively coupling comprises operating a controller cooperating with a plurality of switches to selectively couple the first and second feed conductors to the RF source.

* * * * *